US010822761B1

(12) United States Patent
Voyen

(10) Patent No.: US 10,822,761 B1
(45) Date of Patent: Nov. 3, 2020

(54) LATERALLY AND VERTICALLY ADJUSTABLE FOUNDATION STRUCTURE

(71) Applicant: Airbnb, Inc., San Francisco, CA (US)

(72) Inventor: Nicole Voyen, San Francisco, CA (US)

(73) Assignee: Airbnb, Inc., San Francisco, CA (US)

( * ) Notice: Subject to any disclaimer, the term of this patent is extended or adjusted under 35 U.S.C. 154(b) by 0 days.

(21) Appl. No.: 16/516,147

(22) Filed: Jul. 18, 2019

(51) Int. Cl.

| | |
|---|---|
| ***E02D 5/22*** | (2006.01) |
| ***E02D 35/00*** | (2006.01) |
| ***E02D 27/12*** | (2006.01) |
| ***E04G 25/04*** | (2006.01) |
| *E04G 25/00* | (2006.01) |

(52) U.S. Cl.
CPC ..... *E02D 5/223* (2013.01); *E02D 27/12* (2013.01); *E02D 35/00* (2013.01); *E04G 25/04* (2013.01); *E04G 2025/006* (2013.01)

(58) Field of Classification Search
CPC ..... E02D 5/223; E02D 27/12; E02D 35/00; E02D 5/56; E02D 2600/20; E02D 5/54; E02D 27/34; E04G 25/04; E04B 1/34352
See application file for complete search history.

(56) References Cited

U.S. PATENT DOCUMENTS 2,504,291 A * 4/1950 Alderfer ..... E04G 25/061 254/98
3,815,858 A * 6/1974 Mocny ..... E04G 17/16 248/295.11
4,221,362 A * 9/1980 Van Santen ..... B66F 3/08 248/354.6
5,452,548 A * 9/1995 Kwon ..... E01D 19/041 248/567
6,256,940 B1 * 7/2001 MacKarvich ..... E02D 27/02 52/126.6
6,324,795 B1 * 12/2001 Stiles ..... E02D 27/34 52/167.4
9,926,972 B2 * 3/2018 McGuire ..... F16C 11/0652
10,508,406 B1 * 12/2019 Childress ..... E02D 5/56
2003/0033760 A1 * 2/2003 Rogers ..... E02D 27/34 52/167.7
2007/0028557 A1 * 2/2007 Kelly ..... E02D 27/34 52/741.15
2009/0173036 A1 * 7/2009 Hand ..... E04B 2/96 52/715

(Continued)

*Primary Examiner* — Paola Agudelo
(74) *Attorney, Agent, or Firm* — Maynard Cooper & Gale, LLP; Chitra M. Kalyanaraman, Esq.

(57) ABSTRACT

A foundation structure is made up of a screw that is vertically adjustable into a pile to a desired height, a ball joint connected to the screw, and load bearing components that can be adjusted on the ball joint in 3-dimensional space with respect to the position of the pile. The load bearing components include at least two plates that, between them, define a hollow slot into which an anchor bolt can be held in place vertically while still having allowance for lateral motion. A load bearing plate at the top of the structure can be laterally translated based on movement of the anchor bolt. The load bearing plate is removably couplable to the floor of a building. The structure allows for vertical, lateral, and angular adjustment, providing tolerance for foundation misalignments due to inconsistencies inherent to topography and/or offset between an intended and an actual point of installation.

20 Claims, 17 Drawing Sheets

(56) References Cited

U.S. PATENT DOCUMENTS

| | | | | |
|---|---|---|---|---|
| 2010/0166504 | A1* | 7/2010 | Patton | E02D 5/00 405/230 |
| 2012/0255242 | A1* | 10/2012 | Patton | E01D 15/14 52/126.6 |
| 2013/0043053 | A1* | 2/2013 | Malorni | B25B 13/50 173/216 |
| 2014/0356076 | A1* | 12/2014 | Hale | E02D 5/223 405/255 |
| 2015/0176674 | A1* | 6/2015 | Khan | F16M 7/00 403/120 |
| 2016/0215470 | A1* | 7/2016 | Reusing | E02D 35/005 |
| 2016/0356294 | A1* | 12/2016 | Fenwick | F16B 5/02 |
| 2017/0130418 | A1* | 5/2017 | Servais | E02D 7/02 |
| 2018/0135269 | A1* | 5/2018 | Reusing | E04B 1/34347 |

* cited by examiner

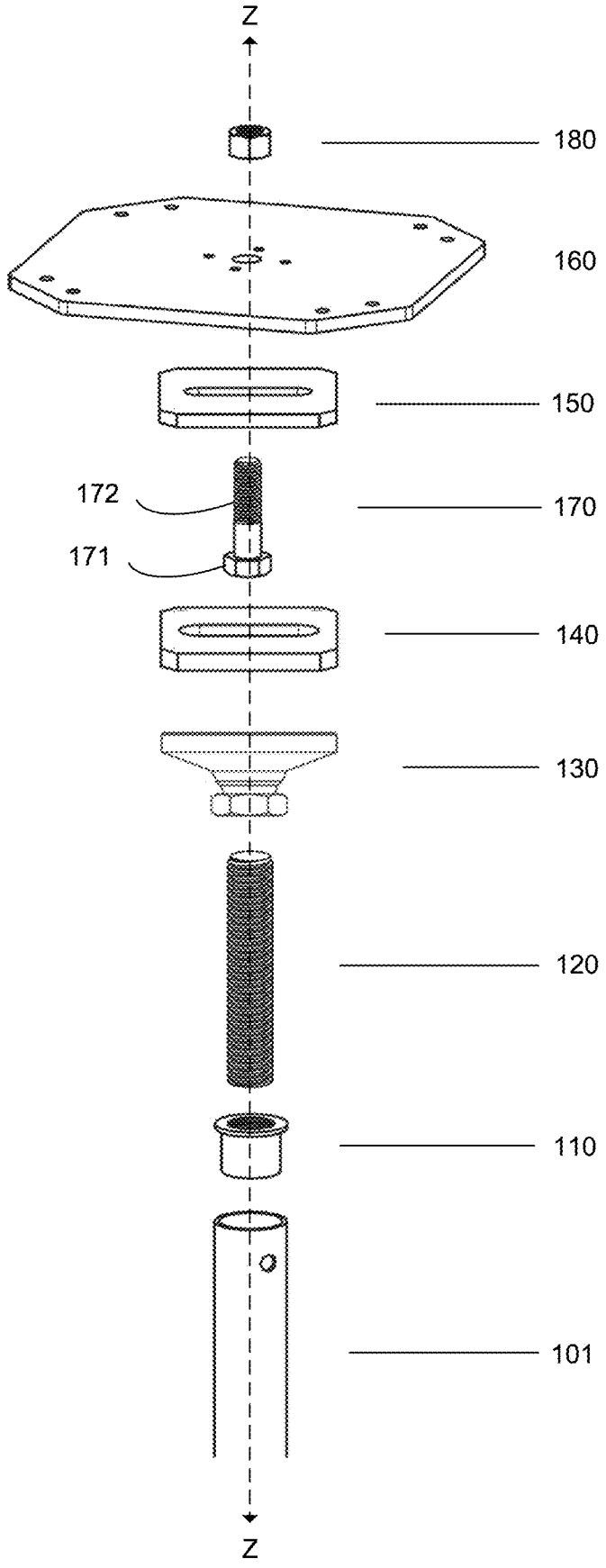
FIG. 3A
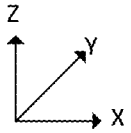

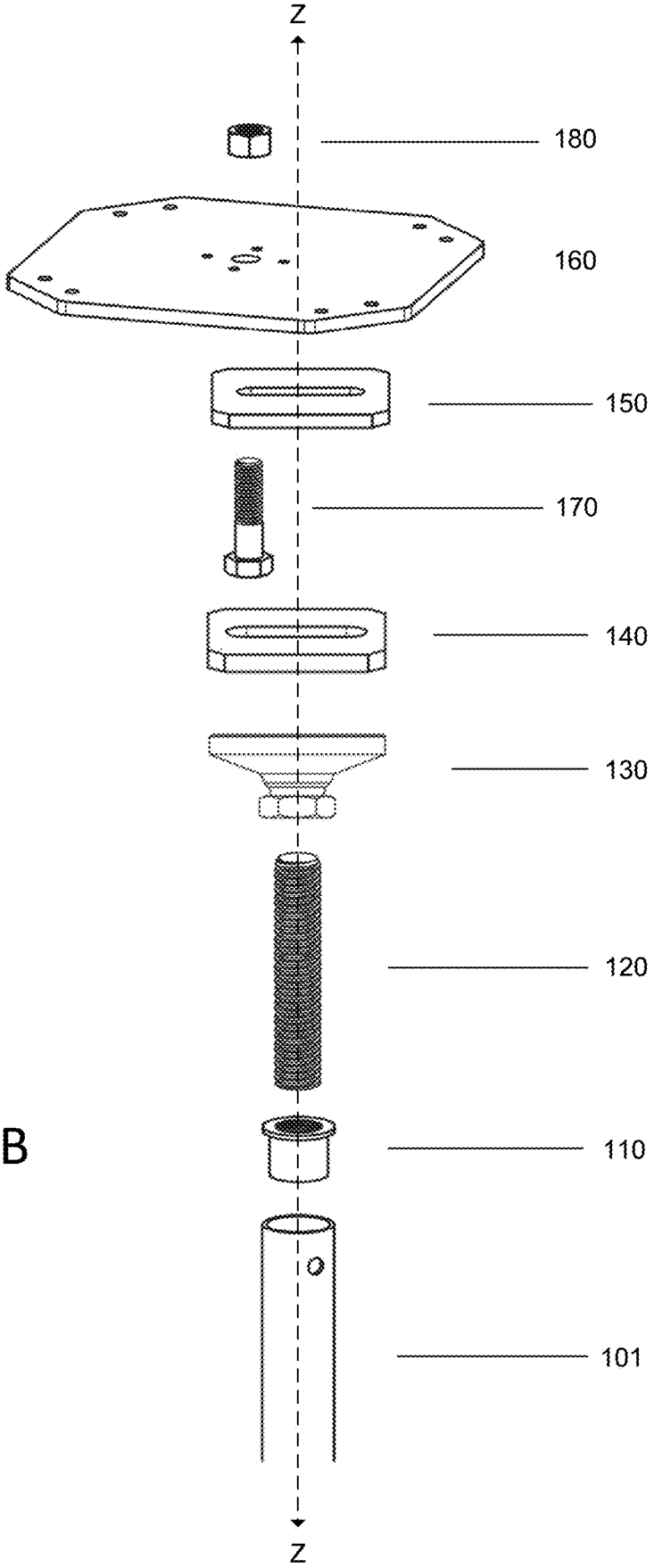
FIG. 3B
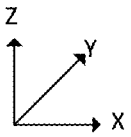

LATERALLY AND VERTICALLY ADJUSTABLE FOUNDATION STRUCTURE

BACKGROUND OF THE INVENTION

Foundation structures are designed to form the base of a building such as a residential, commercial, and/or public property, taking the weight of an above-ground structure (such as, e.g., the gravity load) and transferring that weight to the soil. In most installations, a building's foundation provides a level surface for the structure above it, and distributes the weight of the building evenly to prevent unequal settlement. The foundation of a building is typically housed underground (or partially underground), anchoring the building against natural forces that might otherwise move or unbalance it and providing stability. The reliability of a foundation, therefore, depends on how it is integrated within the soil. Depending on soil conditions of the particular environment where the building is located, different types of foundations may be more beneficially used. For instance, in locations where the soil is looser, the soil may not withstand the load of the building structure at a shallow depth, and a deep-set foundation may be necessary to transfer weight to deeper layers of soil. One known type of deep foundation involves the installation of piles, driven deep into the soil at various predetermined locations. These piles provide a degree of structural stability to the building above it by adding resistance against both vertical forces (that is, gravity) and lateral forces (such as wind or seismic loads) that may impact an already-installed building.

Traditionally, foundation structures are permanently installed at the location at which a building is constructed, and, once those foundation structures are set, the building is constructed thereon. In some cases, these foundations are positioned and secured in place through the application of poured concrete, prior to the construction of the building. Once set in place, this type of foundation structure cannot be easily moved or relocated without digging the structure out in its entirety. If a piled foundation structure is misaligned laterally or vertically during installation the building above may not be able to be anchored in place. Further, in a traditional pile foundation, the displacement of a pile from an intended location may result in an unintended uneven distribution of load across the foundation. In some scenarios, this uneven distribution could ultimately lead to damage to or the structural failure of the building. The process of installing a foundation may therefore be both critical and arduous, requiring a significant amount of manual adjustment.

As a further consequence of their permanency, traditional foundation structures may not be easily removed in circumstances where a property owner wishes to modify or remove a building. Even where the foundation of a building can be removed (e.g., by extensive digging), the component parts of the foundation structure cannot be reused, leading to a great deal of wasted building material. In view of this, an unaddressed need exists in the art for a reusable, low-impact foundation structure that can allow for installation of varied structure layouts in varied environments.

BRIEF DESCRIPTION OF THE DRAWINGS

FIG. 3A is an exploded view of the foundation structure depicted in FIG. 1.

FIG. 3B is an exploded view of the foundation structure depicted in FIG. 1 illustrating a movement of a bolt within the structure.

FIG. 5A is a three-dimensional perspective view of a telescoping screw depicted in

FIG. 1.

DETAILED DESCRIPTION OF THE INVENTION

Figure 1A:
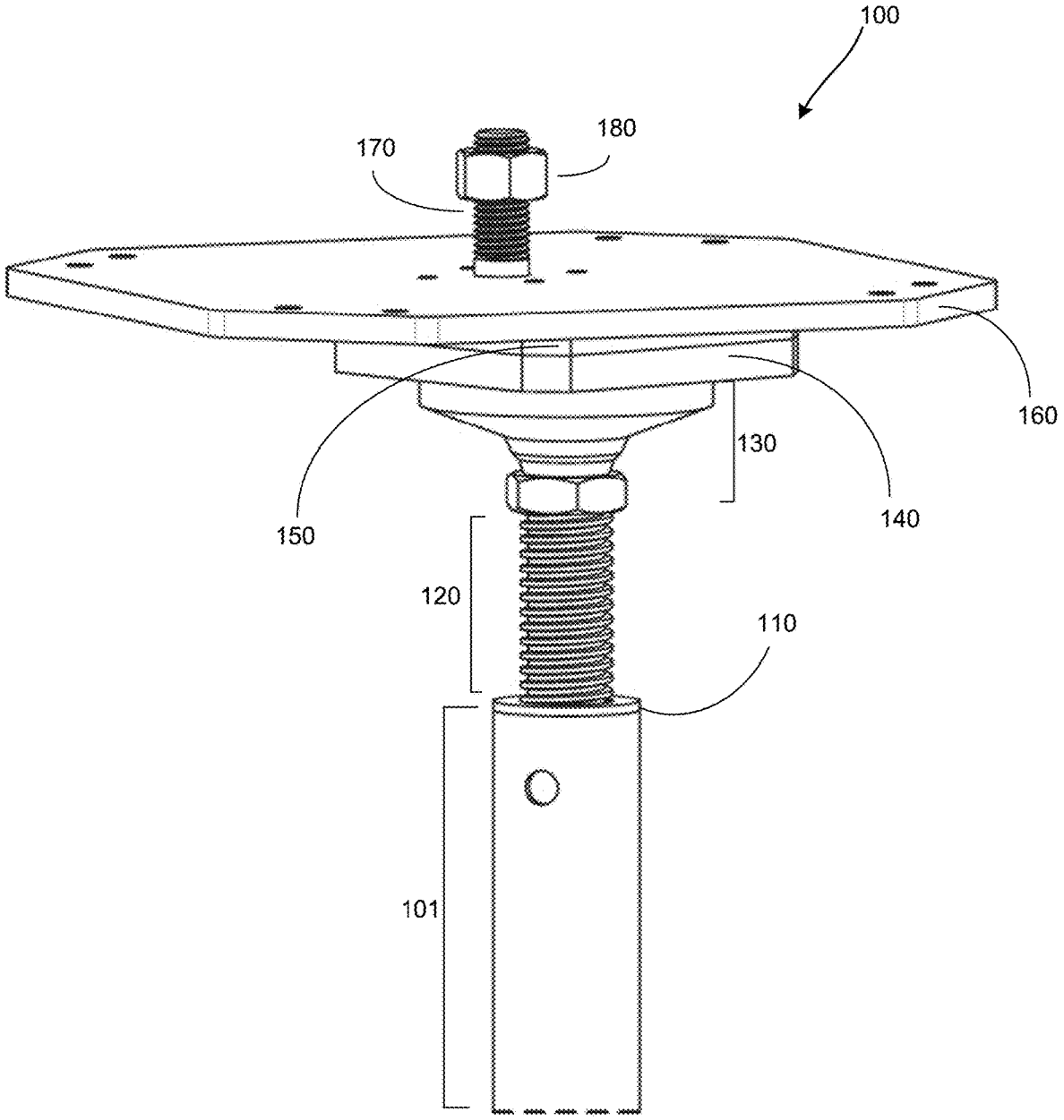
FIGS. 1A and 1B are three-dimensional perspective views of a foundation structure in accordance with some embodiments of the present disclosure.

The present invention is directed to a vertically and laterally adjustable foundation structure that is configured to bear the weight(s) of an above-ground structure (also referred to herein as a superstructure) and any vertical and lateral environmental load(s) applied to the structure, and to transfer those weights and loads to the soil or ground into which the foundation structure is installed. In some embodiments, the foundation structure includes an adjustment mechanism to accommodate an offset between an intended and an actual location of the installation of one or more components of the foundation structure, in a lateral direction. In some embodiments, the foundation structure includes a top portion that pivots within a range of angles with respect to a lower portion, to accommodate angular or non-level surfaces. In some embodiments, the adjustment mechanism may accommodate vertical height discrepancies due to installation or height inconsistencies inherent to geography.

An exemplary foundation structure comprises a ball joint situated on and above a pile, and a series of plates connected to the top of the ball joint, so as to move therewith. The ball joint may be moveable within a range of rotation, facilitating an angular adjustment of the plates to a level position. The plates situated above the ball joint may, in some embodiments, include a first, lowermost plate (base plate) with a slot wide enough to accommodate the head of a bolt, screw, or the like, and a second plate (capture plate) positioned on and above the first plate, with a narrower slot, through which the shank of the bolt extends, thus capturing the head of the bolt within the plates. A third, load bearing plate is positioned above the second plate, the load bearing plate containing a hole just large enough to accommodate the shank of the screw, through which the screw is inserted. The screw has freedom to move laterally within the slots of the first plate and the second plate, such movement facilitating a corresponding adjustment of the load bearing plate in a lateral direction. This lateral and angular adjustability allows for the mitigation of offset caused by the installation of the pile in (or a movement of the pile to) a different location or position from an intended location and position of installation. In some embodiments, a telescoping screw and a threaded cap are situated between the pile and the ball joint, and are configured to provide a mechanism for adjusting a vertical height of the foundation structure.

Due to human or machine error, the process of installing piles during assembly of a building may be inexact, such that one or more piles may be installed at a location or position that is different than the intended location or position. For example, a pile may be displaced laterally from the marked point on the ground by some distance, or it may be driven into the ground in a manner that is angled when it was intended to be placed vertically straight. Further, in some embodiments, for the same superstructure, different piles may have different displacement distances and displacement directions. This may be due to, for example, installation equipment constraints, varying soil conditions, operator error, incorrectly marked pile locations, or any of a variety of other reasons. In some cases, any amount of offset may be small enough to be invisible to the human eye, or, if noticed, may mistakenly be considered negligible, while in other cases, the offset may be more significant or extreme. An exemplary foundation structure, as described hereinafter, provides tolerance for misalignment, mitigating or accommodating the aforementioned problems created due to improper installation of piles. As a result, the exemplary foundation structure may ease the installation process and reduce the installation time, and cost.

FIG. 1A depicts a 3-dimensional view of one embodiment of a foundation structure 100. In the illustrated embodiment, foundation structure 100 includes a ball joint 130 positioned above a telescoping screw 120, a base plate 140, a capture plate 150, and a load bearing plate 160. These components are situated on top of a foundation pile 101, such that the telescoping screw 120 is inserted into a threaded pile cap 110 coupled to the pile. In other embodiments, a pile cap 110 may not be used, and the screw 120 may be inserted directly into a threaded portion of a pile. In an exemplary embodiment, some or all of the components of the foundation structure 100 are made from a metal or mixed metal material, or another material that is structurally sound and of sufficient strength to bear the weight of the above-ground structure and maintain stability against corrosive environmental effects.

Figure 1B:
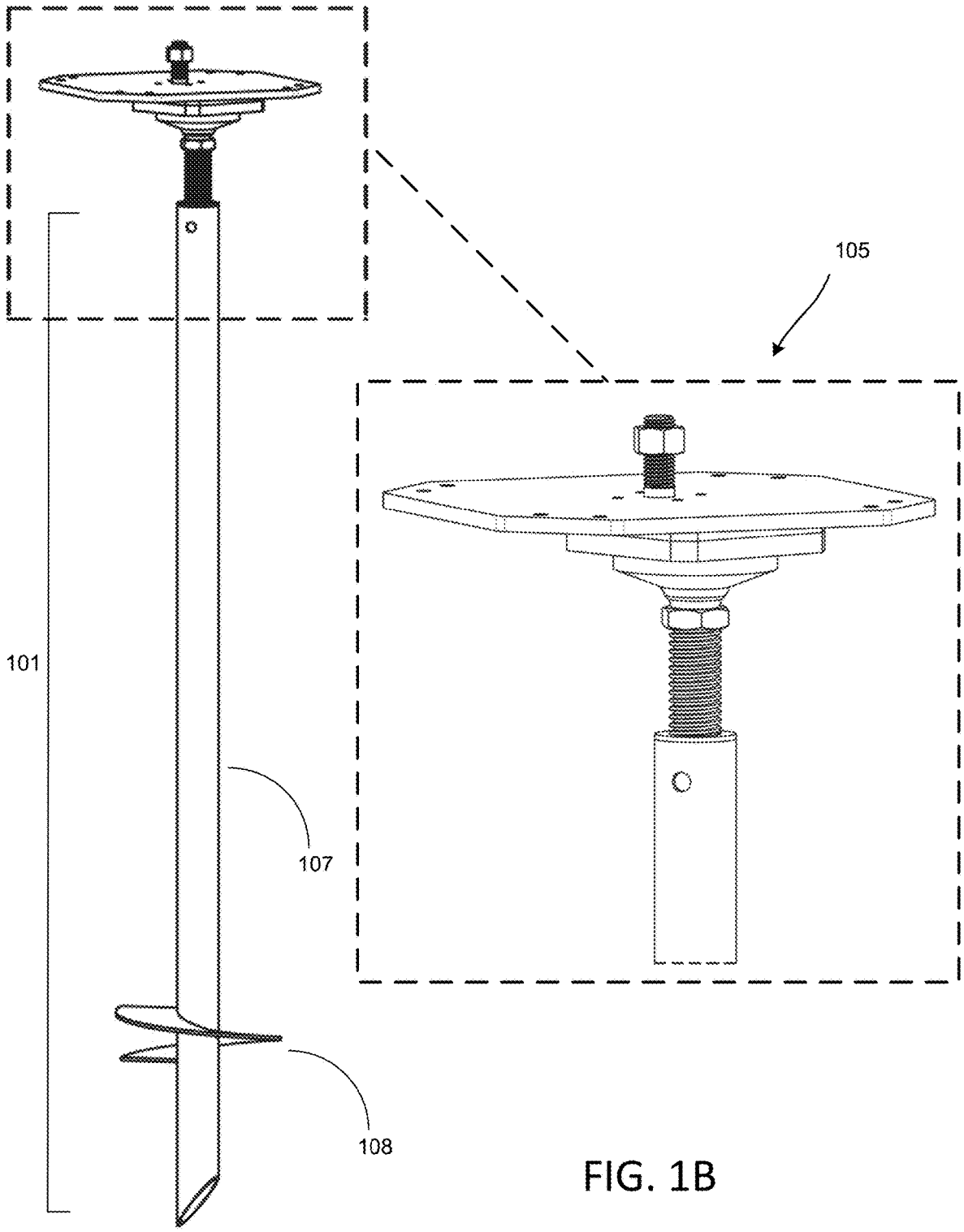

As shown in FIG. 1B, the foundation pile 101 may be relatively long with respect to the other components of the structure 100, though other lengths may be alternately used. Structure 100 may be installed such that all or most of the pile 101 is situated underground, while the other components are situated above ground. With reference to the embodiment of FIG. 1B, the portion of pile 101 illustrated outside of the region 105 (shown separated by dotted lines) may be positioned underground, though of course other placements are possible in other embodiments. Pile 101 is configured to bear the weight (or a portion of the weight) of a superstructure situated above (not shown), and to transfer that weight from the superstructure to the soil. In an exemplary embodiment, the superstructure is an above-ground building, for instance, a house or other residential property or a commercial or public property, though any type of temporary, semi-permanent, or permanent installation may be possible in other embodiments. The foundation of a building may, in some embodiments, require the support of several piles and therefore, necessarily, several foundation structures 100. In one example, a building's foundation may require the installation of at least three discrete foundation assemblies, each including both a pile component and a leveling component (made up of one or more of the other components of the foundation structure shown in FIGS. 1A and 1B). In an embodiment where three foundation assemblies are installed, the three assemblies may be positioned so as to give three points of contact that define a level plane on which the building can be installed. Of course, in other example installations, any appropriate number of piles and any appropriate number of leveling assemblies may be used. In general, it can be understood that a larger building (covering more ground or surface area) or a heavier building (greater above-ground weight) may require the use of more foundation structures than a smaller and/or lighter building.

With reference to FIG. 1A, in one embodiment, a foundation structure 100 may include a telescoping screw 120. One side of screw 120 may be inserted into a pile cap 110 of a helical pile 101 and the other, opposite side may be inserted into a ball joint 130. The interior of the pile cap 101 and of the lower portion of the ball joint 130 have interior threading that allows for the coupling or connection of the screw 120. Screw 120 may be rotated such that more or less of the screw is inserted into the pile cap. This insertion/removal increases or decreases the height of the foundation structure. In this manner, by inserting the screw to a desired position, adjustment in a vertical direction can be provided, where some foundation structures of a building can be of a different height than others, even if the same type of pile is used. This allows a building's foundation to accommodate for height differences between the above-ground portions of different piles 101 of the building, which inconsistencies would otherwise prevent or complicate connection of the foundation structure to the building or cause the building to be out of level. Such height differences between piles might be caused, for example, by variations in the topography of the area in which the structure is intended to be installed, variations in the soil/ground composition at different pile installation points (necessitating deeper or shallower installation thereof), or vertical misalignment of one or more piles during the installation process, among other things.

Ball joint 130 may be coupled to the telescoping screw 120 at a side remote from the threaded pile cap 110. Ball joint 130 provides an adjustment mechanism via which the load bearing components of the foundation structure positioned above the ball joint can freely rotate in 3-dimensional space (or within a limited 3-dimensional space) with respect to the position of the pile, accommodating and/or correcting a degree of misalignment between an intended installation and the actual installation of the pile 101. The ball joint may function together with a slotted plate assembly, described in greater detail below, to accommodate and/or correct such misalignment in the lateral direction. That is, the flooring component of the superstructure that connects to the foundation structure may be misaligned or positioned angularly due to improper installation of the pile, installation procedural constraints, soil, or ground conditions during the installation among others, as mentioned above, and the ball joint allows for angular correction of such mis-positioning.

Figure 2:
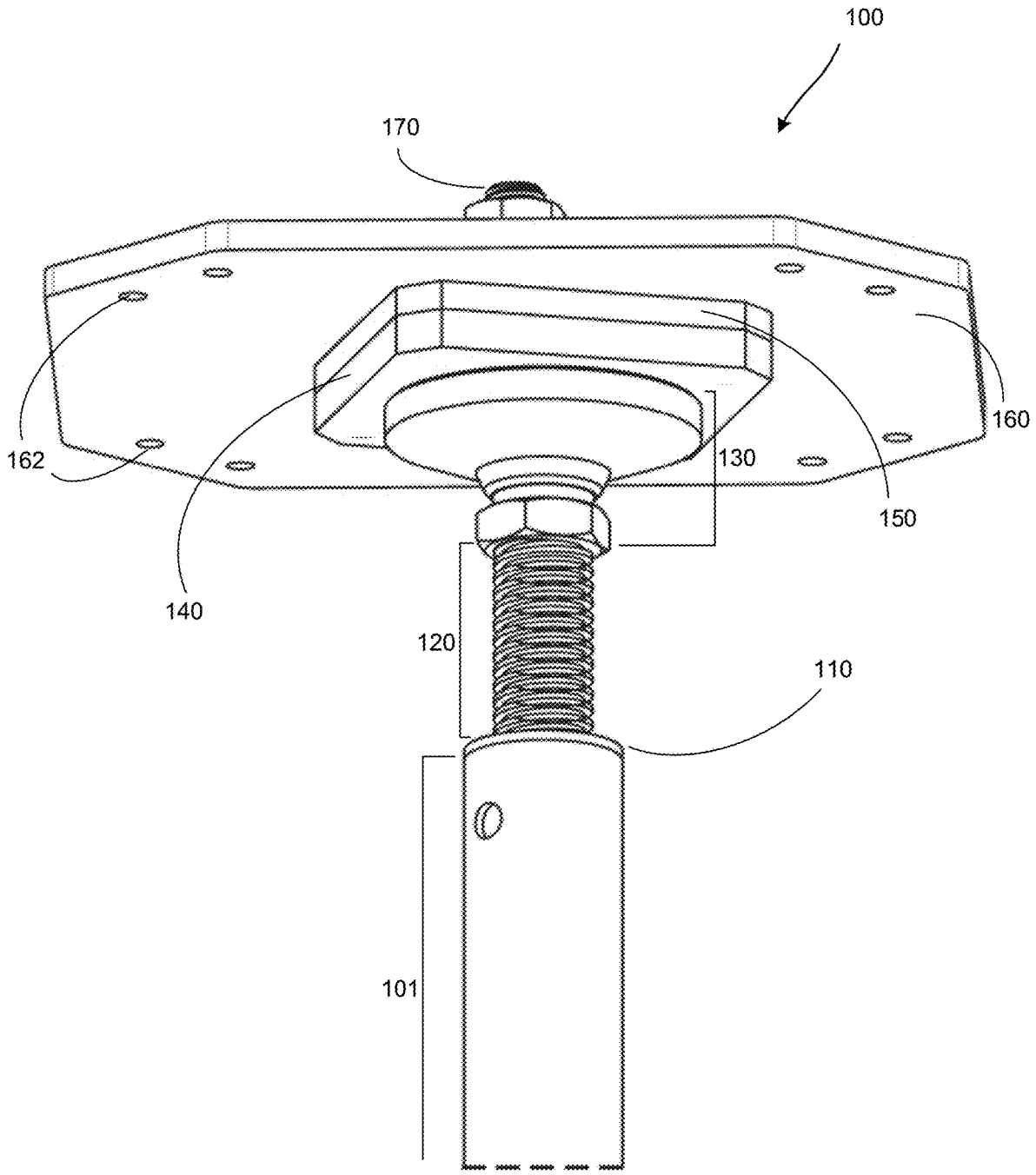
FIG. 2 is a three-dimensional perspective view of the foundation structure in accordance with some embodiments of the present disclosure.

FIG. 2 depicts the foundational structure 100 shown in FIG. 1A from a lower angle, allowing the underside of the exemplary foundation structure to be more clearly seen. As illustrated in FIG. 2, the ball joint 130 may be positioned next to, at its uppermost side, a plurality of plates 140, 150, and 160. FIG. 2 illustrates the first plate 140 (also referred to herein as a base plate) positioned at a top side of and adjacent to the ball joint 130 (at a side remote from the telescoping screw 120). In an exemplary embodiment, the base plate 140 is coupled to the surface of the ball joint 130. In the embodiment illustrated in FIG. 2, the ball joint 130 has a flat top, which top can be understood to be positioned generally parallel to (or coplanar with) the plate 140, though other shapes may be alternately possible. Similarly, the second plate 150 (also referred to herein as a capture plate) may be positioned at a top side of and adjacent to the base plate 140 (at a side remote from the ball joint 130), the capture plate being positioned so as to have a flat bottom surface generally parallel to, and coupled to, a flat top surface of the plate 140, though other shapes may be alternately possible. Further, in the depicted embodiment, a third plate 160 (also referred to herein as a load bearing plate) may be positioned at a top side of and adjacent to the capture plate 150, so that the load bearing plate is generally parallel to the plate 150. In an exemplary embodiment, the load bearing plate has a bottom surface that is wholly or partially flat, and at least a portion of that bottom surface is coupled to a flat top surface of the capture plate 150 (at a side remote from the base plate 140). In other embodiments, one or all of the aforementioned components of the foundation structure 100 may not be parallel to each other, but may instead be of oppositely corresponding shapes (e.g., a convex top surface fitting against a concave bottom surface, or vice versa, among other things) such that adjacent surfaces fit flush against each other. Each of plates 140, 150, and 160 also has a respective defined hollow slot or opening (described in detail later) into which a fastener 170 (in some embodiments, a hex anchor bolt) may be inserted. The fastener 170 is secured in place by, e.g., a nut (or similar component) 180 (FIG. 1).

As described, the base plate 140, the capture plate 150, and the load bearing plate 160 are configured to assist in load transferring from the structure 200 to the pile 101. That is, in some implementations, load bearing plate 160 may be coupled to a flooring element (e.g., a flooring beam or other base or foundational element) of the superstructure (FIG. 11), and may take the load(s) of the superstructure conveyed through that flooring element. In an exemplary embodiment, the load bearing plate may be connected to the flooring element by a removable coupling mechanism, such as one or more screws, bolts, or any other appropriate type of fastener passing through hole(s) 162 of the load bearing plate and into corresponding hole(s) of the flooring structure. However, other types of removable or non-removable connections may be used in other embodiments. Of note, in the depicted embodiment, the load bearing plate 160 may be relatively larger in surface area than the plates 140 or 150, and the plates 140 and 150 may be approximately equal to each other in size/surface area but each may be relatively larger than the size/surface area of the ball joint 130. This sequential decrease in size from top plate to bottom plate and ball joint allows for the weight of the superstructure to be taken by the larger load bearing plate and then concentrated toward a central point and ultimately to the pile 101 and the surrounding soil. In addition, in some embodiments, the decrease in size from top to bottom may function to ensure that the entire top surface of the capture plate remains in contact with the load bearing plate regardless of the configuration of the lateral adjustment of the foundation components. In alternate embodiments, the relative sizes of the plates 140 and 150, the ball joint 130, and the load bearing plate 160 may differ.

FIGS. 3A and 3B illustrate an exploded view of a foundation structure in accordance with the embodiment illustrated in FIGS. 1A and 2. In an embodiment of FIG. 3A, the components of the foundation structure 100 may be coupled together in a manner that is wholly or partially co-axial, that is, the pile 101, the pile cap 110, the telescoping screw 120, the ball joint 130, the base plate 140, the capture plate 150, and the load bearing plate 160 (or any combination or subset thereof) may have a common axis Z-Z passing through the center of each component of the structure 100. In other embodiments, not all of the components of the foundation structure 100 may be co-axial. One such example is the embodiment of FIG. 3B, in which screw 170 has been moved or translated within the slots of plates 140 and 150 (in a manner described in greater detail below) to a side position rather than a centered position.

It may also be generally understood with reference to FIGS. 3A and 3B, that in some embodiments, an assembly of the pile cap 110, the telescoping screw 120, the ball joint 130, the base plate 140, and the capture plate 150 (or any subset thereof) to the pile 100, is symmetrical about an X-Z plane and a Y-Z plane. In an alternate embodiment, the load bearing plate 160 may also be symmetrical about an X-Z plane and a Y-Z plane, though varying shapes are possible. In other embodiments, other configurations where one or more components may be coupled to be symmetrical, or may not be coupled, are possible.

In some embodiments, the pile 101 (FIG. 1B) forms the base portion of the foundation structure 100. As discussed above, pile 101 may be, in an exemplary embodiment, installed wholly or partially in the soil or ground. The size and type of the pile 101 may be selected to allow the pile to provide an appropriate amount of resistance to vertical and lateral loads (e.g., wind load, load due to water pressure), and to transfer those loads to the soil without structural failure. That is, a pile is typically installed deep within the ground, such that the entirety (or close to the entirety) of the pile is below ground, though the particular depth of the installation and the height, shape, and diameter of the pile may depend, for example, on the geographical location and topology of the soil. In the depicted embodiment, a hollow helical pile with a circular cross-section may be used, however, in other embodiments, the structure of the pile may vary. For instance, in an alternate embodiment, pile 101 may be a solid helical pile with a cross-section other than a circular cross-section, such as, e.g., a square or rectangular cross-section. In another embodiment, pile 101 may be constructed from two or more piles arranged in a stacked manner (that is, one atop another). In another embodiment, pile 101 may include one or more pile connectors positioned at the top of the pile (not shown). In still another embodiment, rather than a pile 101 and a pile cap 110, other configurations are possible, for example a pile with an internal threading to accommodate a standard screw or the telescoping screw (without a separate cap). With reference to FIG. 1B, in one embodiment, pile 101 may comprise a pile shaft 107 and one or more helixes 108, where a helix 108 may assist in installing the pile 101 by functioning as a screw for screwing of the pile 101 into soil, and may also provide load bearing support to the pile.

Figure 4A:
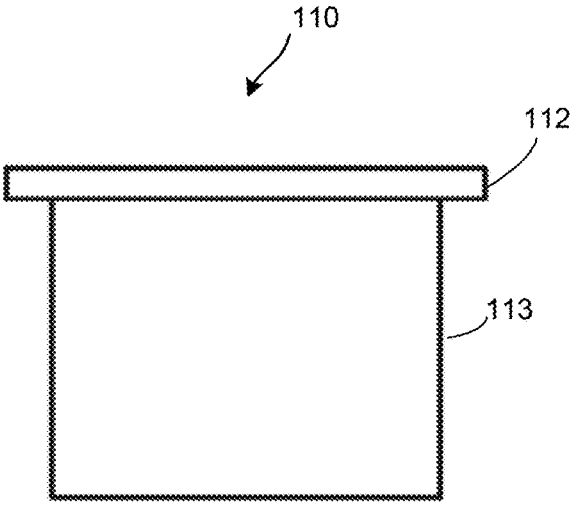
FIG. 4A is a front view of a pile cap depicted in FIG. 1.
Figure 4B:
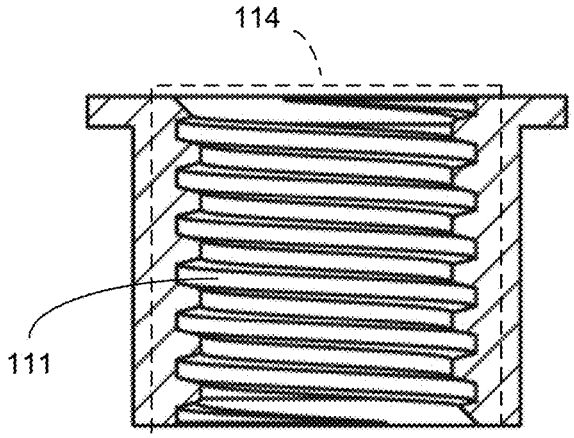
FIG. 4B is a sectional view of a pile cap depicted in FIG. 1.

FIGS. 4A and 4B respectively depict a front view and a sectional view of a threaded cap 110. As illustrated in FIG. 4A, an exemplary threaded cap 110 (also referred to herein as a pile cap) may have a head 112 and a body 113, the head 112 containing an opening to a cavity 114, a hollow interior portion of the body 113 (illustrated in FIG. 4B surrounded by dotted lines). In alternate embodiments, the threaded cap 110 may have other parts in addition to the head and the body (e.g., a lipped rim or the like), or may be a portion of the pile itself (at a topmost section of the pile). In one embodiment, the head 112 sits atop the uppermost portion of the pile 101 and the body 113 can be inserted into the pile 101, thereby creating a coupling between the pile 101 and the pile cap 110. In alternative embodiments, the threaded cap 110 may be inserted in its entirety into the pile 101 proximate to the uppermost portion of the pile 101. This may be, for example, at a portion of the pile that extends out of the soil, though other positions are possible in other embodiments. In another alternate embodiment, the threaded cap 110 may not be positioned at the top of the pile 101 and rather, may be inserted into the pile 101 (at a depth of the pile 101). Further, in still other possible embodiments, threaded cap 110 need not be inserted into the pile, but rather, may be coupled to the pile 101 in other ways. For instance, the head of the pile cap may not rest directly on top the pile 101, and instead may be displaced at a distance from the top of the pile 101 with a part or whole of the body 113 inserted into the pile 101. While, in some embodiments, the pile cap is locked to the pile in a position that is not affected by settling, other embodiments may exist in which a coupling position may vary at different points of installation or lifespan (e.g., after settling, environmental change, or modification of the superstructure after installation or over time).

As illustrated in FIG. 4B, in an exemplary embodiment, threaded cap 110 is hollow, and is configured to have a circular cross section (e.g., a hollow tube). However, in other embodiments, the threaded cap 110 may be of other types, such as, for example, having a hollow shaft with a square (or polygonal or alternately-shaped) cross-section, a solid shaft with a hole, or any other appropriate configuration to correspond to the pile 101. As illustrated, in an exemplary embodiment, the outer diameter of the head 112 of the threaded cap 110 may be equal (or approximately equal) to the outer diameter of the pile 101 and the outer diameter of the body 113 may be less than the inner diameter of the pile 101 (to be accommodated into the pile 101). In other embodiments (not shown), the outer diameter of the head 112 may be greater than the outer diameter of the pile 101 (e.g., so as to form a lip or rim), or may be less than the inner diameter of the pile 101 so as to fit snugly inside the pile 101. In other embodiments, still other dimensions of the threaded cap may be possible. For instance, the head of the threaded cap may be tapered inwardly, such that the outer diameter of the head may be less than the outer diameter of the body of the threaded cap, or alternately, the head of the threaded cap may be tapered outwardly, such that a lowermost portion of the head is smaller in diameter than an uppermost portion.

Referring to FIG. 4B, threaded cap 110 may include an internal threading 111 lining the walls of the cavity 114. This threading 111 may allow for the insertion and securing of a telescoping screw 120 into the threaded cap 110, as will be described in greater detail below. In the illustrated embodiment, the internal threading 111 runs throughout the cavity 114 of the threaded cap 110 (from top to bottom), however, in an alternate embodiment, internal threading 111 may only run for a portion of the cavity (e.g., half). It will be generally understood that in an exemplary embodiment, the threading extends to the topmost portion of the cavity 114 (through the head of the cap) so as to allow for the insertion of screw 120 from above. However, other embodiments are possible where no threading is present in the cavity 114, or where the threading extends through only a middle and/or bottom portion of the cap 110.

The threaded cap 110 may be coupled to a pile 101 by inserting the body 113 (or in some instances the entirety of the cap 110) into an upper or uppermost opening of the pile. In some embodiments, where pile connectors are used, the threaded cap 110 may be positioned atop the pile connector rather than directly on top of the pile. In still other embodiments, where a series of piles 101 on top of each other are used, the threaded cap 110 may be coupled to the uppermost pile of a series of piles. In some embodiments, rather than inserting the threaded cap into an opening of a pile 101, the cap 110 may be connected to an upper portion of the pile 101 via any appropriate type of fastener(s), strap(s), bolt(s), screw(s), or the like.

Figure 5A:
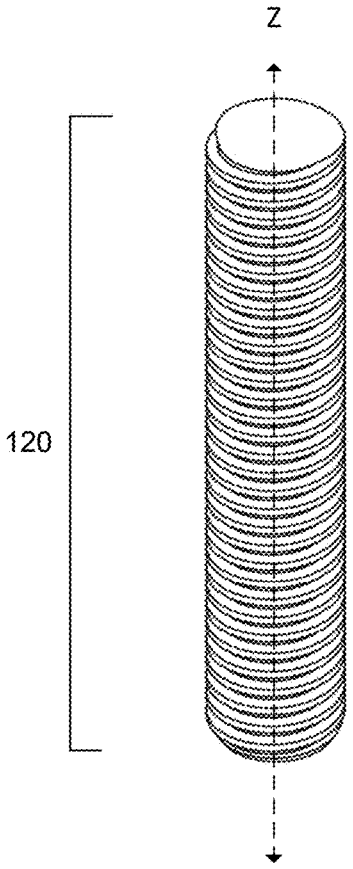
Figure 5B:
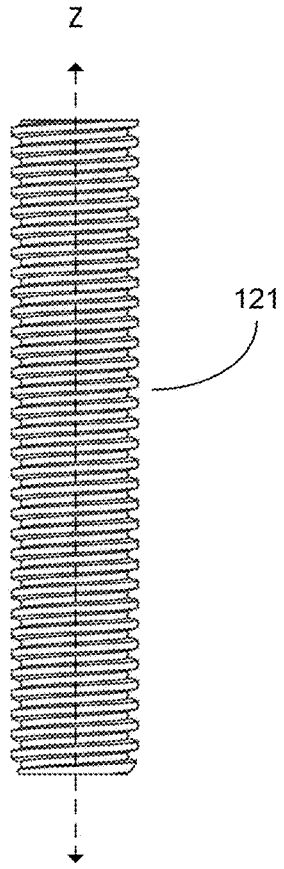
FIG. 5B is a front view of a telescoping screw depicted in FIG. 1.

Referring now to FIGS. 5A and 5B, telescoping screw 120 may include an external threading 121 throughout the screw 120 on an outer portion of the screw 120. Screw 120 may be inserted and secured into the threaded cap 110, as described above. In this regard, the external threading 121 of the screw 120 engages with the internal threading 111 of the threaded cap 110, as the screw 120 is inserted into the cavity 114 of the threaded cap 110.

The vertical (or generally vertical) position of the telescoping screw 120 in the threaded cap 110 may be changed by rotating the screw 120 into the cavity 114 (referred to hereinafter as 'screwing-in') or out of the cavity (referred to hereinafter as 'screwing-out'). That is, a length of the screw 120 inserted into the cavity 114 may be changed in a Z-axis direction by screwing-in or screwing-out, resulting a corresponding change in the length of the screw 120 that is situated outside the threaded cap 110. As a result, the position(s) of the illustrated components of the foundation structure 110 coupled directly or indirectly to a top of the telescoping screw 120 (such as the ball joint 130, the plates 140 and 150, and the load bearing plate 160) are changed with respect to the vertical direction as represented by the direction of the axis Z (FIG. 5B). This change in a desired in/out length allows for the screw 120 to be "telescoping." The change in length of the portion of the screw extending from the pile cap facilitates a vertical height adjustment of the foundation structure 100, wherein the height of the foundation structure 100 above the pile 101 may be increased by screwing-out the threaded screw 120 and the height of the foundation structure 100 above the pile 101 may be decreased by screwing-in the threaded screw 120. In an exemplary embodiment, screwing-in may be done by rotating the screw 120 in a clockwise direction and screwing-out may be done by rotating the screw 120 in a counterclockwise direction, however, the opposite may be true in alternate embodiments.

Other characteristics of the screw 120 may also change in different embodiments. For instance, a total length of the screw 120, a number of threads 121 of the screw, the type and size of threading 121, and/or the diameter of the screw 120 may vary depending on the vertical height adjustment changes and the structural capacity of the screw 120 that are necessary to provide resistance without failing under load. As one example, with respect to structural capacity, as an adjustable length of the screw gets longer, the diameter of the screw may necessarily grow to prevent buckling. The strength of the screw threads may also be increased by changing the thread type, e.g., from traditional to an acme type thread.

In some embodiments, the telescoping screw 120 may be configured to be screwed into the cap 110 and may extend further into the pile 101 beyond the cavity 114 of the cap 110, through a bottom of the cap 110 (i.e., through a hole in the bottom of the hollow threaded cap 110). For purposes of explanation, in one illustrative embodiment, telescoping screw 120 may be screwed into the cap to a maximum of 6 inches, facilitating a maximum amount of vertical height adjustment of the foundation structure 100, e.g., approximately 4.5 inches of maximum vertical height adjustment, accounting for the length of the screw that engages with the threads of the cap and the threads of the interior of the ball joint, though of course other lengths are possible. In other embodiments, the telescoping screw 120 may not extend beyond the cavity 114 of the cap 110, often a distance of significantly less than 6 inches. Other embodiments may contain other arrangements of screw 120 for accommodating height changes, such as, e.g., a standard screw, a shaft of which may translate in the vertical direction (e.g., vertically upwards or vertically downwards) through the cap 110 and/or the pile 101, partially or wholly threaded screws, and/or other configurations.

Figure 6A:
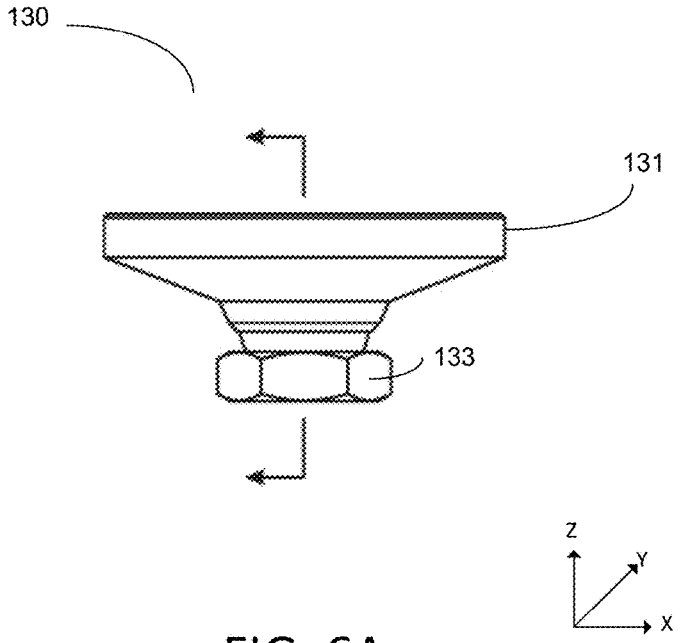
FIG. 6A is a front view of a ball joint depicted in FIG. 1.
Figure 6B:
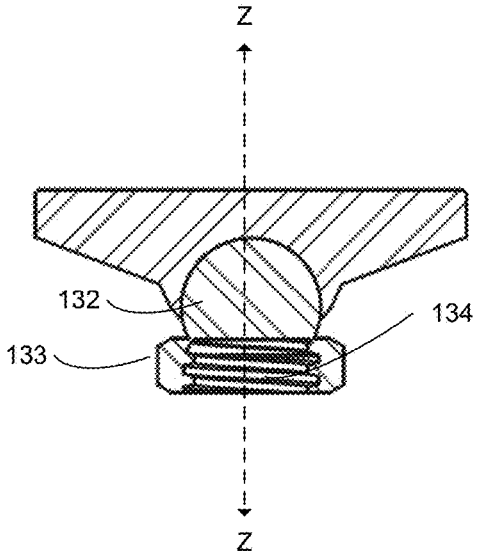
FIG. 6B is a sectional view of a ball joint depicted in FIG. 1.
Figure 6C:
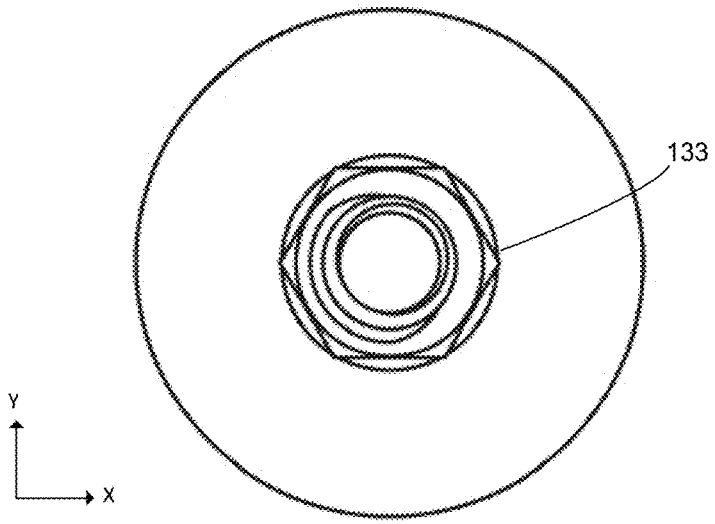
FIG. 6C is a bottom view of a ball joint depicted in FIG. 1

FIGS. 6A, 6B, and 6C respectively depict a front, sectional, and top view of a ball joint 130 in accordance with some embodiments. As illustrated, ball joint 130 includes a body 131, a ball 132, and a nut 133. The nut 133 of the ball joint 130 may include an internal threading 134 that allows for the insertion of and coupling with the telescoping screw 120. More particularly, in some embodiments, one end of the telescoping screw 120 (the end opposite to the screw end inserted in the threaded cap 110) is welded (or otherwise permanently affixed) to the nut 133 of the ball joint 130 to secure the screw 120 to the ball joint. In another embodiment, that end of the telescoping screw 120 may be screwed into the nut 133, where the external threading 121 of the telescoping screw 120 may engage with the internal threading 134 in the nut 133 to secure the telescoping screw 120 to the ball joint 130. In an exemplary embodiment, some or all of the components of the ball joint 130 are made from a metal or mixed metal material, or another material that is of sufficient strength to maintain structural stability against the forces applied by the weight and/or environmental load(s) of the superstructure (transferred through the plates, as described further below) and against environmental effects (e.g., corrosion or lateral forces).

The ball 132 may allow a limited range of free rotation of the components above the ball joint with respect to the components below. Put another way, through rotation of the ball 132, ball joint 130 allows the plates coupled to the body 131 of the ball joint to pivot with respect to a vertical axis Z-Z passing through the center of the ball joint 130 (FIG. 6B) in a manner described in greater detail below. This rotation of the ball joint is described herein as a "pivot" or "swivel" within a permitted angular tolerance away from the axis Z-Z. As a result of this pivot motion, the body 131 of the ball joint 130 may be rotated (or rotationally positioned) to any intended point about the X and Y axes that is within the range of the pivoting motion of the ball joint 130. In some embodiments, the range of the pivoting motion of the ball joint 130 may be further limited by the physical structures above and below the ball joint. This rotational movement about the Z-axis, both separately and in combination with the movement of an anchor bolt 170 within slot 141 of the base plate and slot 151 of the capture plate (described in greater detail below) provides lateral adjustability to the upper portions of the foundation structure 100. Through this, the components of the foundation structure 100 coupled to and above the body 131 may be moved relative to the components located below the ball joint 130 (e.g., the screw 120 and/or the pile 101 and pile cap 110), in a manner described in greater detail below. For purposes of explanation, in one exemplary embodiment, the ball joint 130 may pivot to a maximum design tolerance with respect to the axis Z-Z passing through a center point of the ball 132, however, it will be understood that other ranges of pivot (or hinged rotation, swivel, or other appropriate types of rotation) may be possible in other embodiments, limited by the physical constraints of the other components of the foundational structure 100.

While the body 131 of the ball joint 130 is illustrated in FIGS. 6A-6C as being rounded, other shapes and/or sizes may be possible in other embodiments, so long as rotation around the ball 132 is permitted. Of note, the topmost surface of the body 131 is, in an exemplary embodiment, a flat and level surface (or approximately so), to allow for a flush fit between the top surface of the body 131 and a bottom surface of a plate 140 (described in greater detail below). Other embodiments may be implemented where the top surface of the body 131 is curved, angled, or otherwise shaped, for example where the bottom surface of plate 140 has an oppositely corresponding shape, or where body 131 and plate 140 do not fit so as to be fully flush.

Figure 7A:
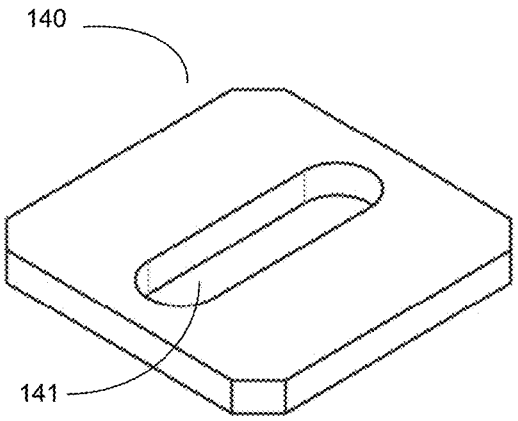
FIG. 7A is three-dimensional perspective view of a base plate depicted in FIG. 1.
Figure 8A:
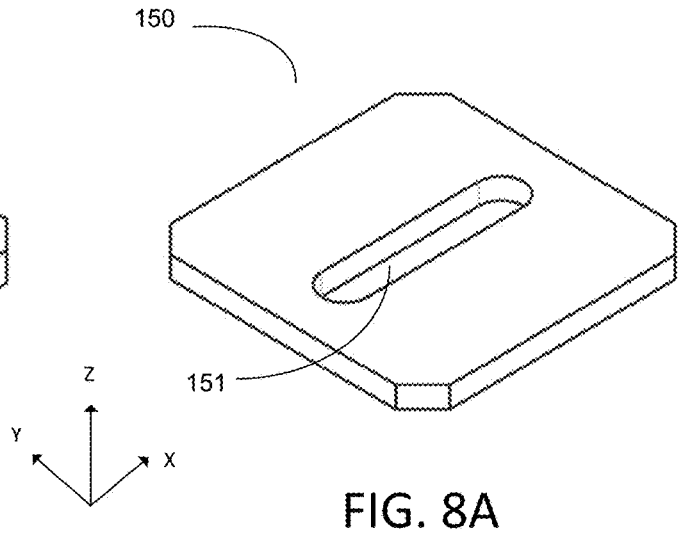
FIG. 8A is three-dimensional perspective view of a capture plate depicted in FIG. 1.
Figure 7B:
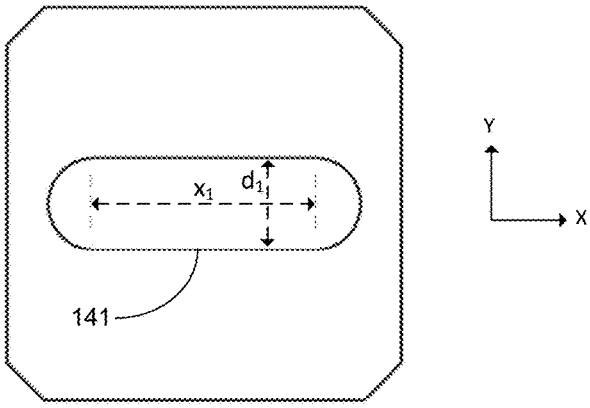
FIG. 7B is a top view of a base plate depicted in FIG. 1.
Figure 8B:
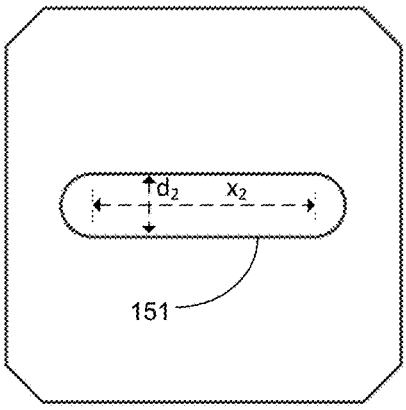
FIG. 8B is a top view of a capture plate depicted in FIG. 1.
Figure 7C:
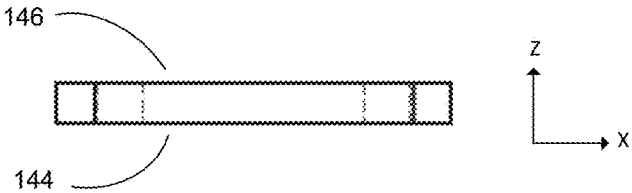
FIG. 7C is a side view of a base plate depicted in FIG. 1.
Figure 8C:
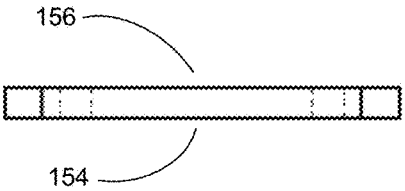
FIG. 8C is a side view of a capture plate depicted in FIG. 1.

FIGS. 7A, 7B, and 7C respectively depict a front, top, and side view of a base plate 140, in accordance with some embodiments. FIGS. 8A, 8B, and 8C respectively depict a front, top, and side view of a capture plate 150, in accordance with some embodiments. In an exemplary embodiment, the base plate 140 and the capture plate 150 may be of a relatively similar size and shape, with a rectangular cross-section, though other shapes (e.g., circular) may be used in other embodiments. The respective similarities and differences between the base (lower) plate 140 and the capture (upper) plate 150 are described below. In an exemplary embodiment, some or all of the plates 140 and 150 (or a portion of one or more plates) are made from a metal or mixed metal material, or another material sufficient to maintain stability against the force imparted by the load(s) of the superstructure and against corrosive environmental effects. Further, in general, the dimensions, shape, and material of the base plate 140 and the capture plate 150 can be chosen to bear the load(s) of the superstructure 200 (conveyed through the load bearing plate 160) and to transfer the loads to the pile 101 without structural failure.

In an exemplary embodiment, base plate 140 includes a slot 141 (FIGS. 7A, 7B) and capture plate 150 includes a slot 151 (FIGS. 8A, 8B), as described earlier. Slot 141 extends through base plate 140 (from top to bottom, in the Z-axis direction) so as to create a hole through the plate. Similarly, slot 151 extends through capture plate 150 (from top to bottom, in the Z-axis direction) so as to create a hole through the plate. Slots 141 and 151 are generally symmetrical in nature with respect to the X-Z plane and the Y-Z plane however other, symmetric or non-symmetric configurations may be possible. For instance, a hexagonal slot may be used in the base plate to provide more surface area to the captured bolt. In an exemplary embodiment, the length $x_1$ of the central, flat portion of the slot 141 (FIG. 7B) and the length $x_2$ of the central, flat portion of the slot 151 (FIG. 8B) are equal or approximately equal to each other, however, in other embodiments, the lengths $x_1$ and $x_2$ may differ such that either of slot 141 or slot 151 may be longer or shorter than the other. In other embodiments, slot 141 and slot 151 may have equal or approximately equal end-to-end lengths (at the farthest ends of the respective slots along the X-axis), however other lengths may be possible in other embodiments.

Referring to FIG. 2 and FIG. 3A, the base plate 140 may be coupled to and positioned on top of ball joint 130, where a portion of (or all of) a bottom side 144 of the base plate 140 (FIG. 7C) may be coupled to a top side of the body 131 of the ball joint 130 (FIG. 6A). In one embodiment, this coupling is done by welding, such that the base plate 140 and the ball joint 130 are integral to each other, however, other types of coupling mechanisms (e.g., fasteners, rivets, bolts, screws, etc.) may be used in other embodiments. With reference to FIG. 2, it can be seen that in an exemplary embodiment, the surface area of an upper side of the body 131 of the ball joint 130 is smaller than the surface area of the bottom side 144 of the base plate 140, and accordingly, only a portion of the bottom side 140 will come into contact with and/or be coupled to the body 131 of the ball joint. Similarly, all or a portion of a bottom side 154 of the capture plate 150 (FIG. 8C) may be coupled to a top side 146 of the base plate 140. In one embodiment, this coupling can be done by welding, or another permanent affixture, such that the base plate 140 and the second plate 150 are integral to each other, however, other types of non-permanent coupling mechanisms (e.g., fasteners, rivets, bolts, screws, etc.) may be used in other embodiments so that the components may be detachable. It may be generally understood that coupling of the capture plate and the base plate is completed after the screw has been captured therebetween. However, different embodiments may exist where the coupling is begun either after or during the placement and capture of the screw, e.g., the screw may be first positioned and captured before affixation is begun, or the affixation process may progress or complete the positioning of the screw. Further, in an exemplary embodiment, the base plate 140 and the capture plate 150 may be coupled such that the slots 141 and 151 may line up, with a center point of the width of one slot aligning with a center point of the width of the other slot. In some embodiments, the slots 141 and 151 may be aligned when coupled such that they are coaxial, sharing a common center Z-axis.

Figure 9A:
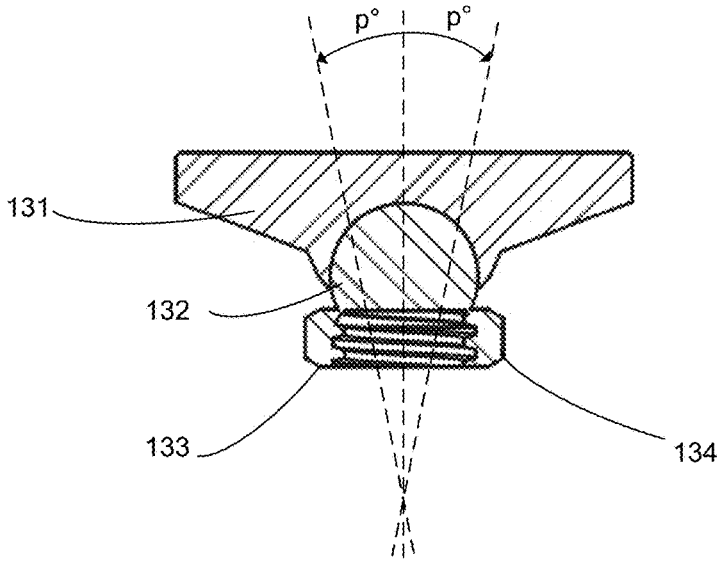
FIGS. 9A and 9B are diagrams illustrating movement of a foundation structure in accordance with some embodiments of the present disclosure.
Figure 9B:
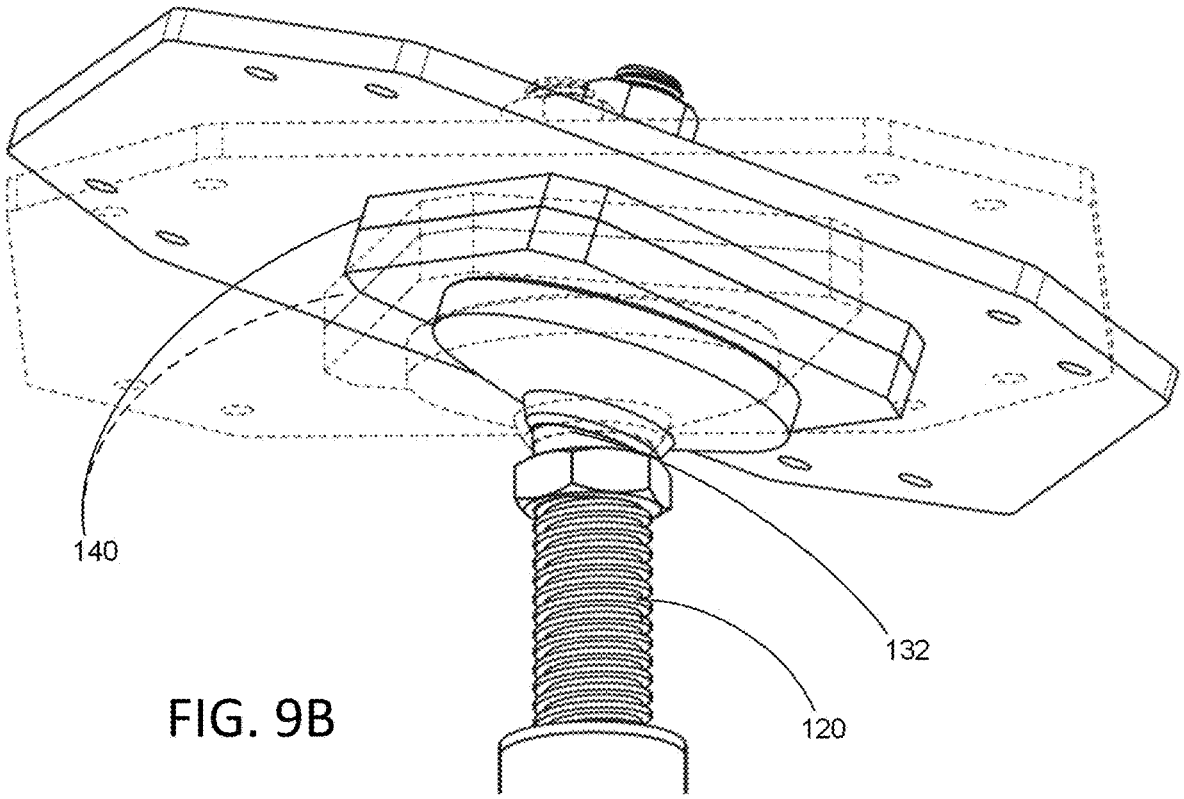

The coupling of the base plate 140 and the capture plate 150 to the ball joint 130 may facilitate the motion of the plates 140-150 along with the motion of the ball 132 of the ball joint 130, in a manner illustrated in FIGS. 9A and 9B. As shown in FIG. 9A, the body 131 of the ball joint 130 pivots, with respect to the ball 132, to a particular angle within the permitted range of p degrees in any 3-dimensional direction. Configurations may be possible in other embodiments where the ball 132 moves relative to a stationary body 131, or where other components of the ball joint 130 function to move the body 131 to a pivoted position. For purposes of explanation, in one embodiment, p may be a value of 7.5 degrees or less, however, other angular tolerances may be implemented in other embodiments to allow for a greater or lesser range of free rotational motion. Still other embodiments may exist where the ball joint may permit a first range ($p_1$°) of free rotational movement in one direction, and a more limited range ($p_2$°) of free rotational motion in another direction; that is, the permitted range of rotation is not equally balanced. In yet another embodiment, rotational motion may stopped or otherwise limited to only a certain 3-dimensional area. This motion may be understood as a hinged motion of an axis passing through the center of the body 131 against the ball 132, which is, in some embodiments, coupled to and integral with the stationary base (nut 133) of the ball joint 130. Because the plates 140 and 150 are coupled to (or in some embodiments are integral with) the body 131 of the ball joint 130, the pivoting motion of the ball 132 results in the movement of plates 140 and 150 in cohesion with the body 131, as can be seen in FIG. 9B. In some circumstances, this pivot may be done intentionally, e.g., to accommodate an installation where the pile is not levelly installed while the body 131 and the plates positioned above are intended to be positioned levelly. In some circumstances, the pivoting of the ball joint may be done without conscious intention, for example, when leveling the flooring support on top of the foundation structure, or after installation, to accommodate settling or movement of the soil and/or the superstructure. This movement along with the ball joint allows for an angular adjustment of the plates through which the loads of the superstructure's will be transferred, without the need to reinstall, move, or otherwise adjust the pile 101, screw 120, or any of the other components situated below the ball joint 130.

Figure 10A:
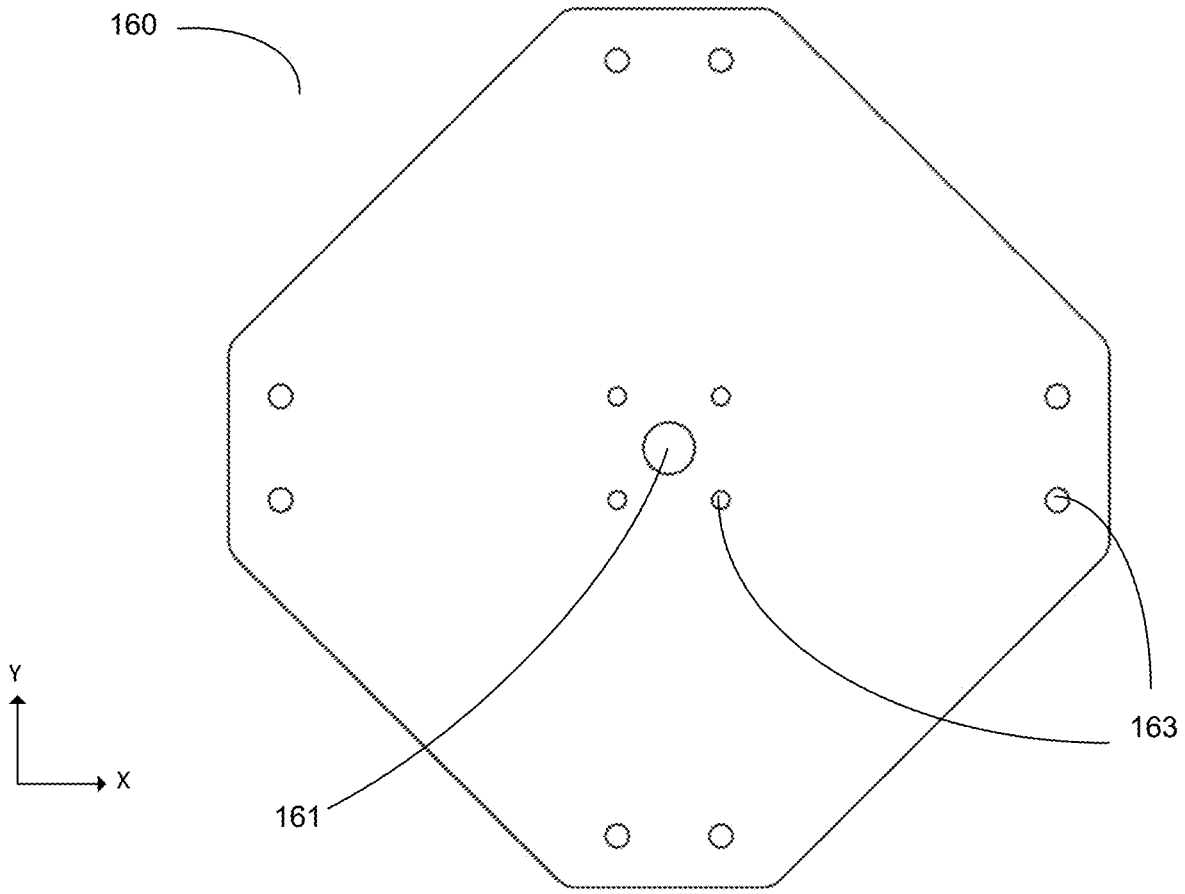
FIG. 10A is a top view of a load bearing plate depicted in FIG. 1.
Figure 10B:
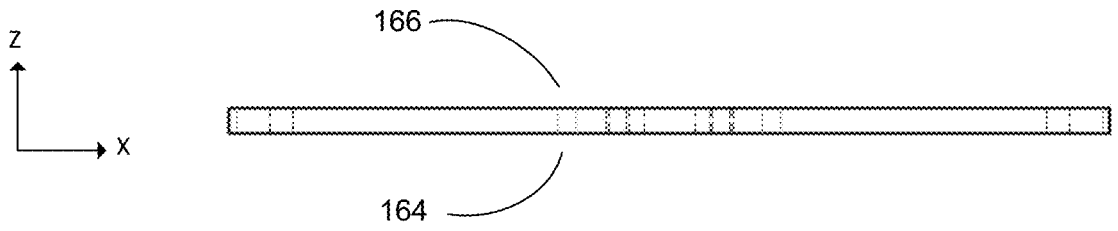
FIG. 10B is a side view of a load bearing plate depicted in FIG. 1.

FIGS. 10A and 10B respectively depict a top view and a side view of a load bearing plate 160. As illustrated, load bearing plate 160 may include a hole 161 that can receive a fastener such as an anchor bolt 170 (described below). Load bearing plate 160 is positioned such that at least some portion of a bottom side 164 of load bearing plate 160 comes into contact with a top side 156 of the capture plate 150. In an exemplary embodiment, load bearing plate 160 is not permanently coupled to the capture plate 150 but instead, is connected to the capture plate via the fastener 170 that extends through slot 141 of the base plate, slot 151 of the capture plate, and hole 161 of the load bearing plate. Fastener 170 is, in an exemplary embodiment, an anchor bolt (e.g., a hexagonal anchor bolt) however, other appropriate types of screws, bolts, or connectors may be used in other embodiments. In the illustrated embodiment, a hexagonal anchor bolt (as opposed to a circular head) facilitates the capture of rotation in the capture plate however differently-shaped heads may be possible in different embodiments. The fastener 170 must be a sufficient size and type to allow for some degree of movement of the fastener within the slots 141 and 151 (described below).

Figure 11:
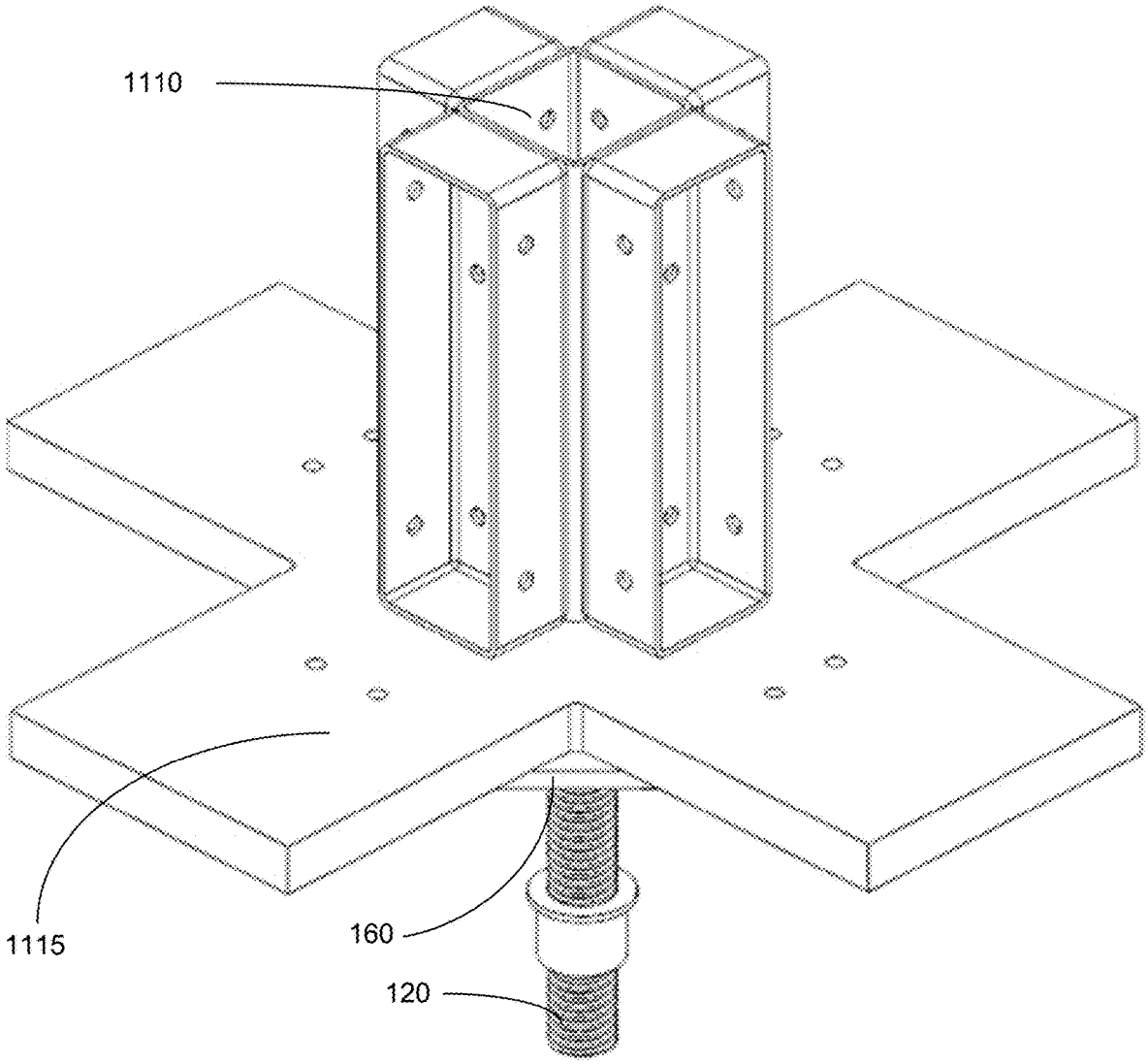
FIG. 11 is a third-dimensional perspective view of a foundational structure attached to a flooring element of a building, in accordance with some embodiments of the present disclosure.

In one embodiment, illustrated in FIG. 11, the load bearing plate 160 may be connected, via fasteners inserted through holes 163, to a connective flooring element 1110 of a building (shown in FIG. 11 with a thermal break material 1115 separating the load bearing plate 160 from the connective flooring element, though other embodiments are possible), where the connective flooring element accepts and connects one or more floor beams. The connective flooring element 1110 shown in FIG. 11 is merely illustrative, and any appropriate flooring component may be used in alternate embodiments. In other embodiments, no connective flooring element and/or thermal break material is used, and instead, the load bearing plate 160 may be connected, directly or indirectly, to a floor beam, a floor board, a concrete block or structure, and/or another part of a base or flooring structure of the building. In still other embodiments, the load bearing plate may not be fastened to any component of the flooring of the building, and may instead be held in place by the force of the weight of the building applied thereon.

The dimensions and the material of the load bearing plate 160 may be chosen so that the plate may bear the load of the super structure without breaking. In one embodiment, the material may be (in whole or in part) a metal or mixed metal material, or another material sufficient to maintain stability against forces imparted by the loads of the superstructure and against corrosive environmental effects. In an exemplary embodiment, the configuration (e.g., shape and placement) of the load bearing plate 160 depends on the location at which the foundation structure 100 is deployed with respect to the superstructure. For example, if the foundation structure 100 is configured to be deployed at the edge of the superstructure, the load bearing plate 160 may be a T-plate, and if the foundation structure 100 is configured to be deployed in a central or interior point of the superstructure, the load bearing plate may be, e.g., a hexagonal shape (as in FIG. 10A), a squared shape, a circular shape, or any other appropriate shape. In general, the bearing plate is shaped in a manner that accommodates the travel of the capture plate. In some embodiments (not shown), an additional foundation mounting plate may be positioned between the load bearing plate 160 and a flooring beam, intersection of flooring beams, or other flooring component of the superstructure, and such additional foundation mounting plate may be considered part of the foundation structure 100.

Figure 12:
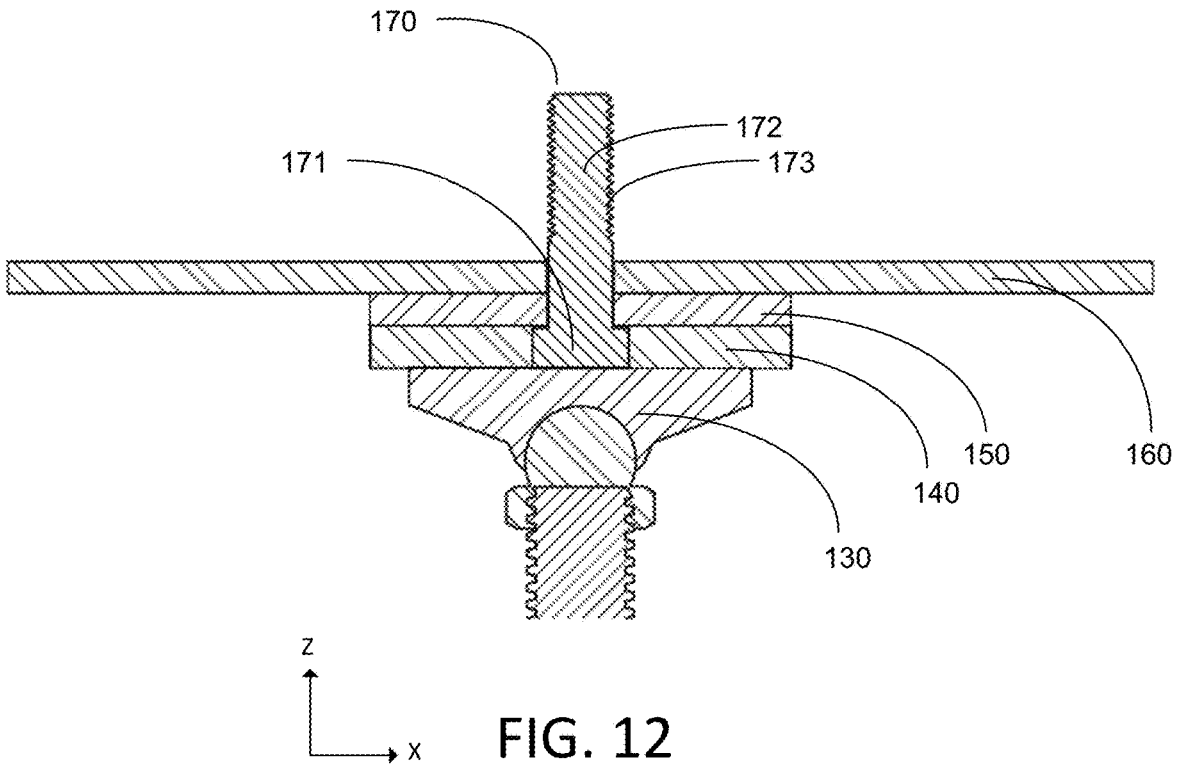
FIG. 12 is a sectional view of an embodiment of a foundation structure in accordance with some embodiments of the present disclosure.
Figure 13:
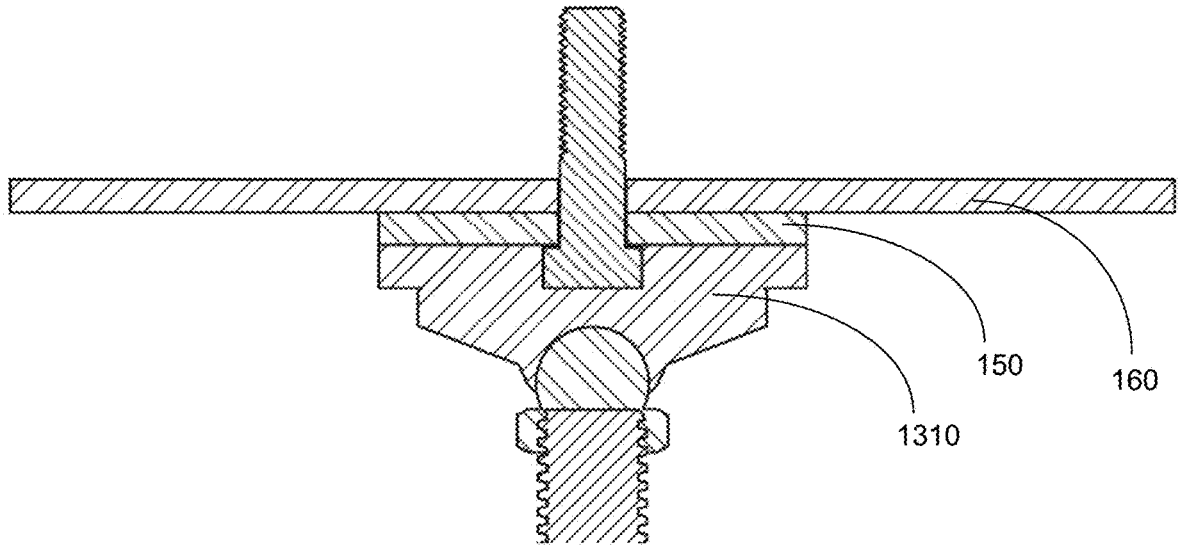
FIG. 13 is a sectional view of an embodiment of a foundation structure in accordance with some embodiments of the present disclosure.

FIG. 12 illustrates an embodiment in which a fastener 170 (also referred to as anchor bolt 170), is positioned vertically so as to extend through slot 141 of the base plate 140, slot 151 of the capture plate 150, and hole 161 of the load bearing plate 160. The illustrated anchor bolt 170 is made up of a head 171 and a shank 172. As depicted, the dimensions (e.g., length, width, and depth) of the slots 141 and 151 are such that the head 171 is accommodated and secured in the slot 141 and the shank 172 runs vertically upwards through the slot 151. In the exemplary embodiment, the width of the slot 151 is not large enough to accommodate the head 171 of the anchor bolt. Because of this, the head of the anchor bolt is restricted from being pulled vertically upward through the slot 151. The anchor bolt is also bounded on the bottom by the top surface of the body 131 of the ball joint, and therefore, the anchor bolt also cannot be moved vertically downward, remaining within the slot 141. In other embodiments, such as that depicted in FIG. 13, the base plate 140 may not be a separate component from the ball joint 130, and instead, a combined unit 1310 with a slot 141 may be used, however the functionality of slot 141 and slot 151 remains generally unchanged.

While the particular configuration and size of the slots 141 and 151 may vary, in the embodiment of FIG. 12, the slot 141 is wide enough to accommodate the head of the anchor bolt but not wide enough to allow for rotation of the head of the anchor bolt within the slot 141. That is, the anchor bolt 170 is restricted from rotating within slot 141 but may translate (i.e., move) laterally within the slot. The slot 151 is wide enough to accommodate the shank 172 of the anchor bolt and to allow for the lateral movement of that shank within the slot. This lateral movement is illustrated by the directional arrow A in FIG. 14. As can be seen in the embodiment illustrated in FIG. 14, lateral translation of the anchor bolt in the Y-axis direction is restricted due to the size of the slots, however, other configurations may be possible in other embodiments. Additionally, the maximum distance of lateral translation of the anchor bolt in the X-axis direction is restricted by the length of the slots 141 and 151, and in particular, by the length of the smaller of the two slots. For instance, where length $x_2$ of slot 151 (FIG. 8B) is smaller than length $x_1$ of slot 141 (FIG. 7B), lateral movement of the anchor bolt in the X-axis direction is restricted to a distance of $x_2$. For purposes of example, in one embodiment, the anchor bolt 170 may be designed to translate to a maximum of 1-2 inches along the slots 141 and 151, though of course the length may vary in other embodiments.

Turning back to FIG. 12, anchor bolt 170 extends through the slots 141 and 151 and through hole 161 in the load bearing plate 160. The location of the hole 161 on the load bearing plate 160 may depend, e.g., on the shape of the load bearing plate and the area to which the load of the superstructure may be applied. In embodiments where the load bearing plate is generally symmetrical (as in FIG. 10A-10B), the hole 161 is typically located at a center point of the load bearing plate. The diameter of the hole 161 is chosen such that the anchor bolt 170 snugly fits with the hole 161 (without, e.g., moving or rattling in the hole). The anchor bolt 170 may further include threading 173, allowing a threaded nut 180 (FIGS. 1A, 3) to be fastened to the anchor bolt 170 above the load bearing plate 160, preventing vertical movement of the load bearing plate. This secures the load bearing plate (and in some embodiments, components of the super structure) to the plates 140 and 150 and thereby to the structure below.

Figure 14:
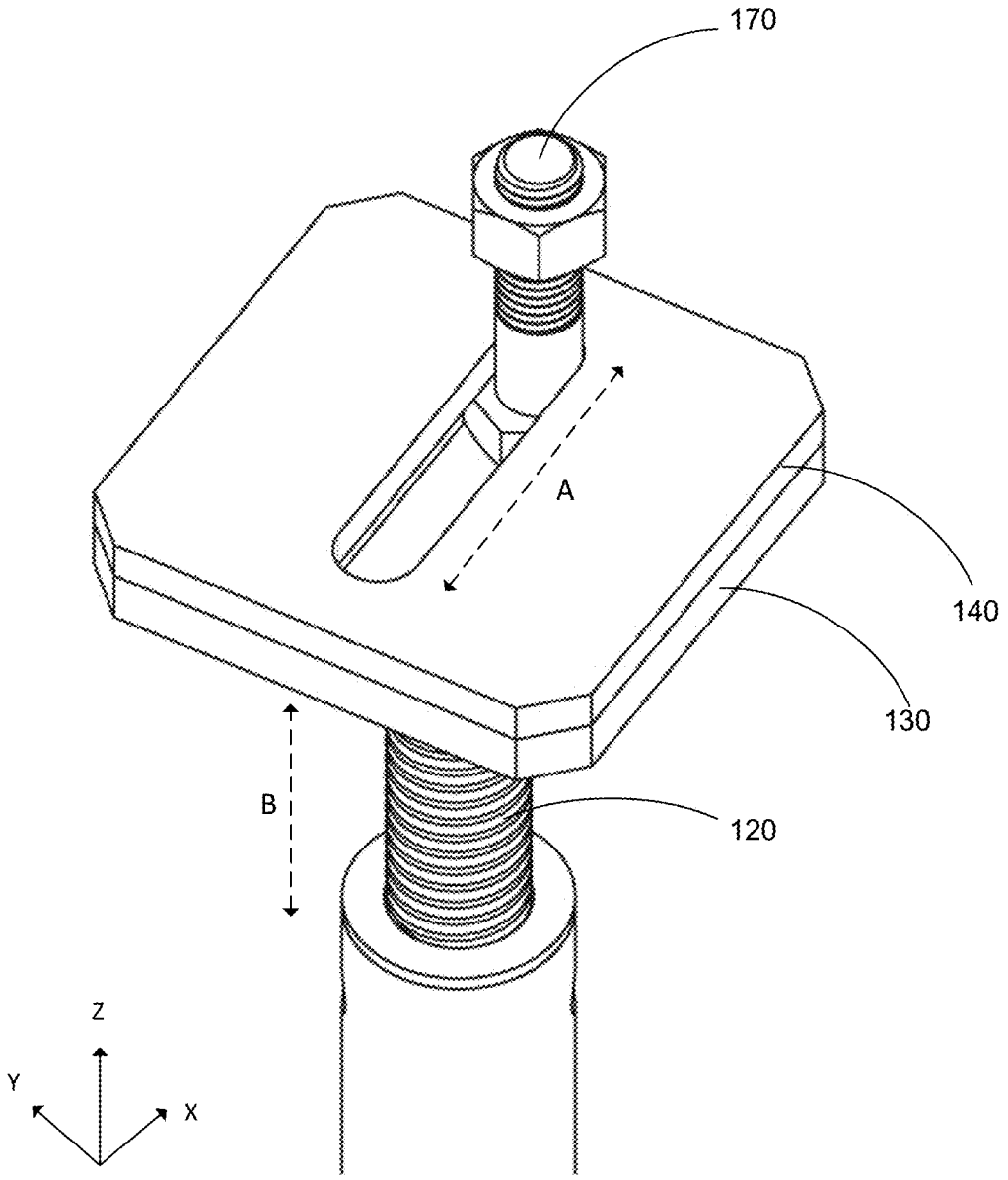
FIG. 14 is a diagram illustrating movement of a foundation structure in accordance with some embodiments of the present disclosure.
Figure 15A:
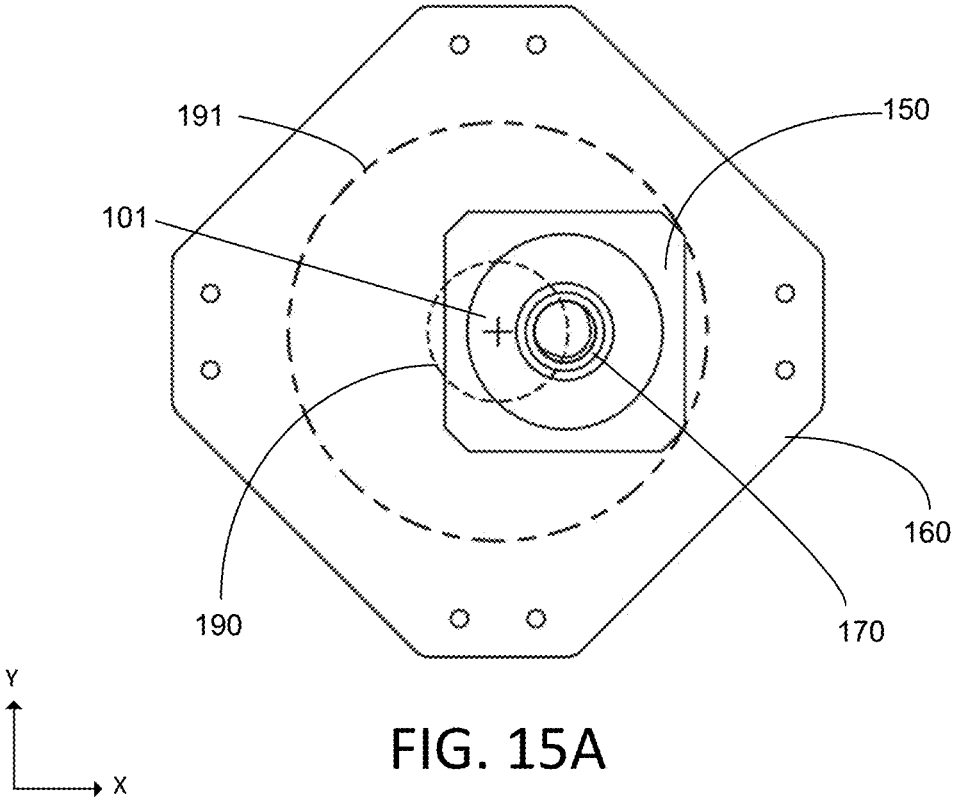
FIG. 15A is a bottom view of an embodiment of lateral adjustment window of a foundation structure, in accordance with some embodiments of the present disclosure.
Figure 15B:
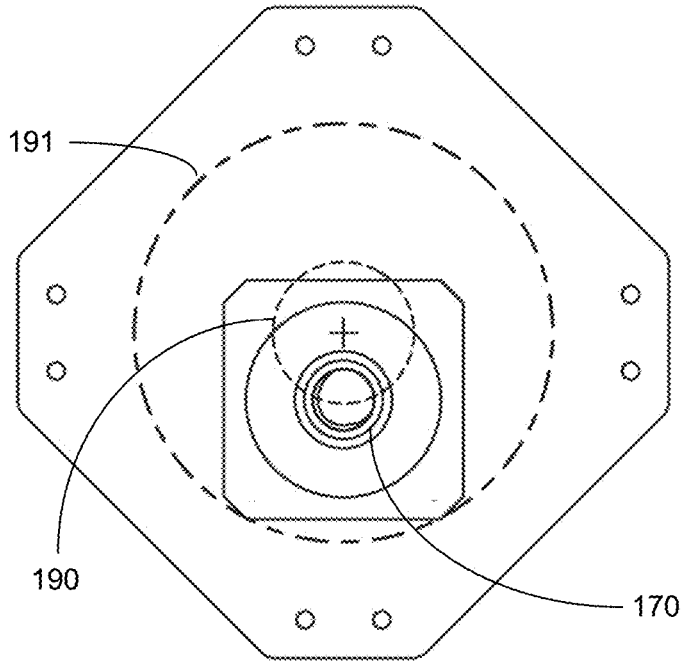
FIG. 15B is a bottom view of an embodiment of the lateral adjustment window of the foundation structure in accordance with some embodiments of the present disclosure.

While the load bearing plate 160 is not specifically shown in FIG. 14 for ease of illustration, the depicted movement of the anchor bolt 170 in the direction of arrow A of that figure would also result in the corresponding movement of the load bearing plate 160. More particularly, the anchor bolt 170, when moving laterally in the slots in a lateral direction A, pushes a side of the hole 161 in the lateral direction A, enabling the load bearing plate to be moved laterally with respect to the pile 101 and the foundational components below the load bearing plate 160. FIGS. 15A and 15B illustrate this lateral movement, depicting bottom-up views of a lateral adjustment window of the load bearing plate, in accordance with some embodiments of the present disclosure. Referring to FIG. 15A, element 190 represents an amount of permissible offset of the foundation pile from the intended location of the pile 101, the offset being relative to the position of the load bearing plate. Element 191 represents a load bearing area, a maximum area in which design tolerance allows for the center of the load bearing plate to be moved as a result of the lateral movement of the anchor bolt 170. The position of the load bearing area 191, the limitations of the size and shape of the slots 141, 151, and the limitations on rotation of the ball joint body 131 about the Z-axis create a lateral adjustment window, namely, a maximum area in which design tolerance allows for the center point of the anchor bolt 170 (positioned in hole 161 at the center of the load bearing plate) to be adjusted. The exemplary foundation structure facilitates the anchor bolt 170 to be moved across to any location within the lateral adjustment window. When the load bearing plate is positioned at a desired location within the load bearing area 191, the weight of the superstructure (or portion of that weight) applied through this load bearing area will be transmitted to the capture plate 150 and the foundation components below.

As illustrated in FIG. 15A, a lateral movement of the anchor bolt 170 has in turn moved the central point of the load bearing plate laterally away (in an X-axis direction) relative to the position of the capture plate 150, the ball joint 130, and the other components of foundation structure 100 located below. Similarly, FIG. 15B illustrates a lateral movement of the anchor bolt 170 in the Y-axis direction so as to position the load bearing plate in a different location in the load bearing area 191, for example in an embodiment where the slots 141 and 151 are positioned in a manner to allow y-direction movement. Rotation of the ball joint body 131 about the Z-axis (not specifically shown) would result in the movement of the positioning of the central point of the load bearing plate in still another location in the load bearing area (different from the original position of the central point of the loading bearing plate in one more of an X-axis, Y-axis, and a Z-axis direction). In other embodiments, other configurations may be possible, e.g. where the anchor bolt 170 travels in either or both of an X-axis direction and a Y-axis direction, as permitted by the slots 141, 151 and by the rotation of the ball joint body 131 about the Z-axis, for accommodating lateral adjustments.

This lateral movement may be beneficial in an exemplary scenario where the pile 101 has been misaligned or installed at a location laterally offset from an intended installation location. In such example scenario, pile 101 may be displaced from the intended location by a certain distance in, e.g., an X-axis direction or a Y-axis direction. The anchor bolt 170 may need to be laterally moved so that the load bearing plate may be centered over a desired spot of the load bearing area 191. Through this movement, the load bearing plate 170 can be positioned over the actual point of installation of the pile 101, allowing for the structural load to be transferred through the load bearing plate 160 to the soil via the pile (and other components of the structure 100), without the need to reposition, realign, or dig up the pile 101 and move it to its intended location. For purposes of explanation, in one example embodiment, the anchor bolt may allow for the load bearing plate to be moved ±30 mm laterally, thereby compensating for a lateral pile misalignment of up to ±30 mm, though of course other distances may be possible in other embodiments depending on the size and configuration of the plates 140-160 and the slots 141 and 151.

Figures 16, 17, 18:
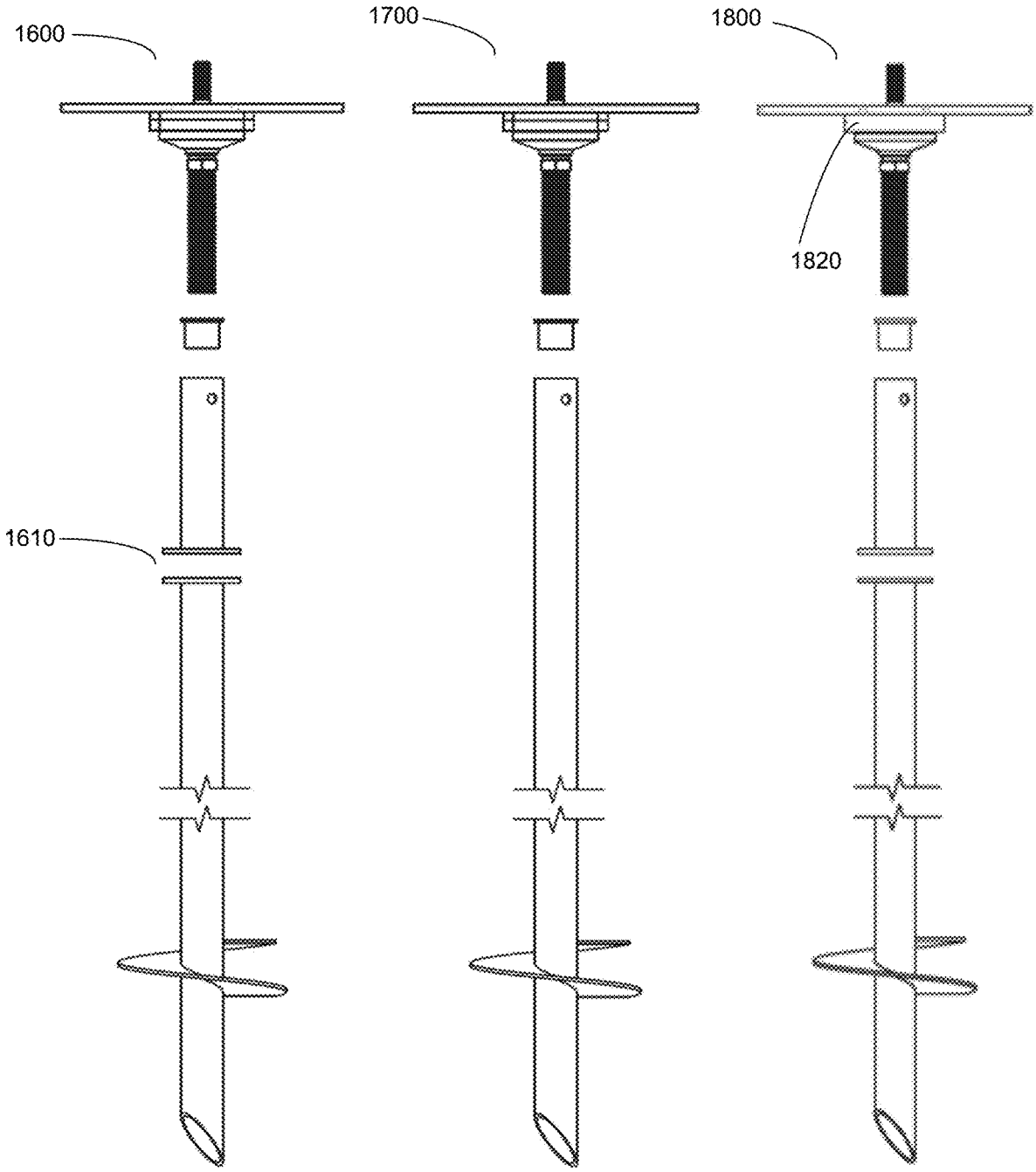
FIG. 16 is a front view of the foundation structure in accordance with some embodiments of the present disclosure.
FIG. 17 is a front view of the foundation structure in accordance with some embodiments of the present disclosure.
FIG. 18 is a front view of the foundation structure in accordance with some embodiments of the present disclosure.

FIGS. 16 through 18 depict various embodiments of the foundation structure. FIGS. 16 and 18 respectively depict a load bearing plate, capture plate, base plate, ball joint, screw, and pile cap similar to those depicted in FIG. 1A. FIG. 16 depicts a structure 1600 in which two piles are stacked atop each other at a connective point 1610. FIG. 17 is similar to the illustration of FIG. 16, however, FIG. 17 depicts a structure 1700 in which a single, continuous pile is used. FIG. 18 depicts a structure 1800 containing a load bearing plate, ball joint, screw, and pile cap similar to those depicted in FIG. 1A. However, unlike FIG. 1A, in structure 1800, base plate 140 and capture plate 150 are implemented as a single unitary structure labelled as plate 1820. It may be generally understood that, in an embodiment with a unitary structure 1820, the anchor bolt positioned in the slot(s) therein is still moveable, i.e., in an exemplary embodiment, the anchor bolt was inserted prior to the completion of the welding of different components.

Figure 19:
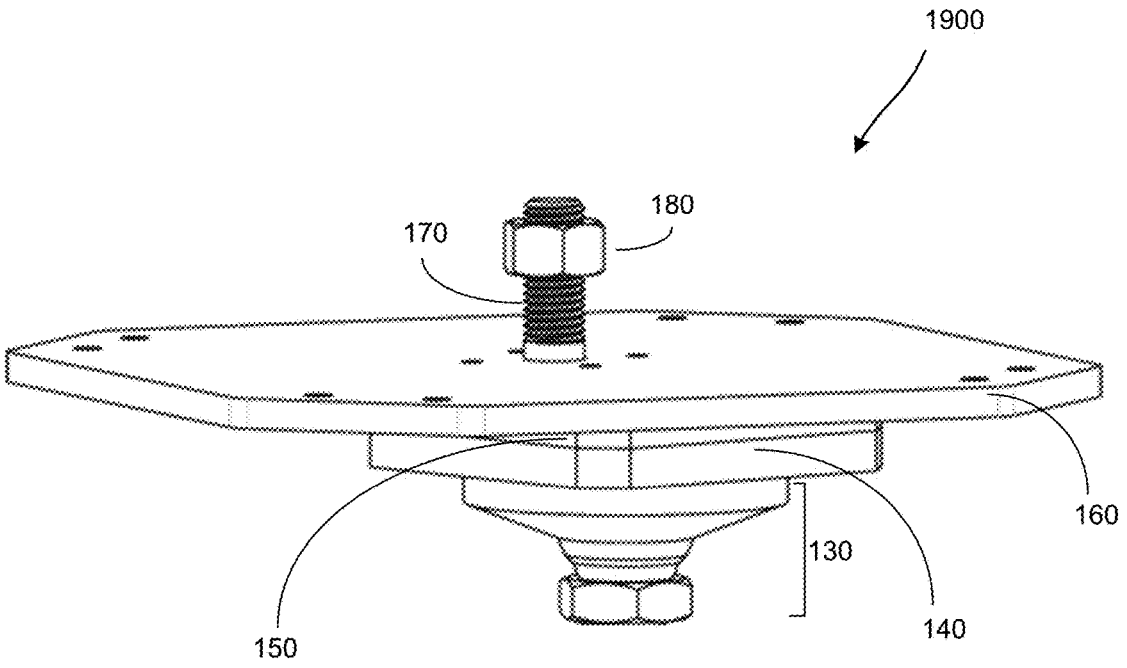
FIG. 19 is a three-dimensional perspective view of a foundation structure in accordance with some embodiments of the present disclosure.

FIG. 19 depicts an embodiment of a foundation structure 1900 that includes a ball joint 130, a slotted base plate 140, a slotted capture plate 150, and a load bearing plate 160, where a bolt 170 is inserted into a slot of the base 140 and a slot of the capture plate 150 and through a hole in the load bearing plate 160 (secured by a nut 180). Foundational structure 1900 does not include a screw 120, pile cap 110, or pile 101, though it may be connectable to a pile. For example, the ball joint 130 may be configured to connect directly to any standard screw, and indirectly to a standard pile. In this embodiment, the foundation structure 1900 allows for a lateral adjustment (through the lateral movement of the bolt 170 in a manner similar to that described with reference to FIGS. 12-15B) and also allows for an angular adjustment (through the pivot of a ball of the ball joint 130). In alternate embodiments, the foundation structure 1900 may also include one or more additional plates that act to connect the load bearing plate to a portion of a superstructure (e.g., a building) positioned above the foundation structure.

Figure 20:
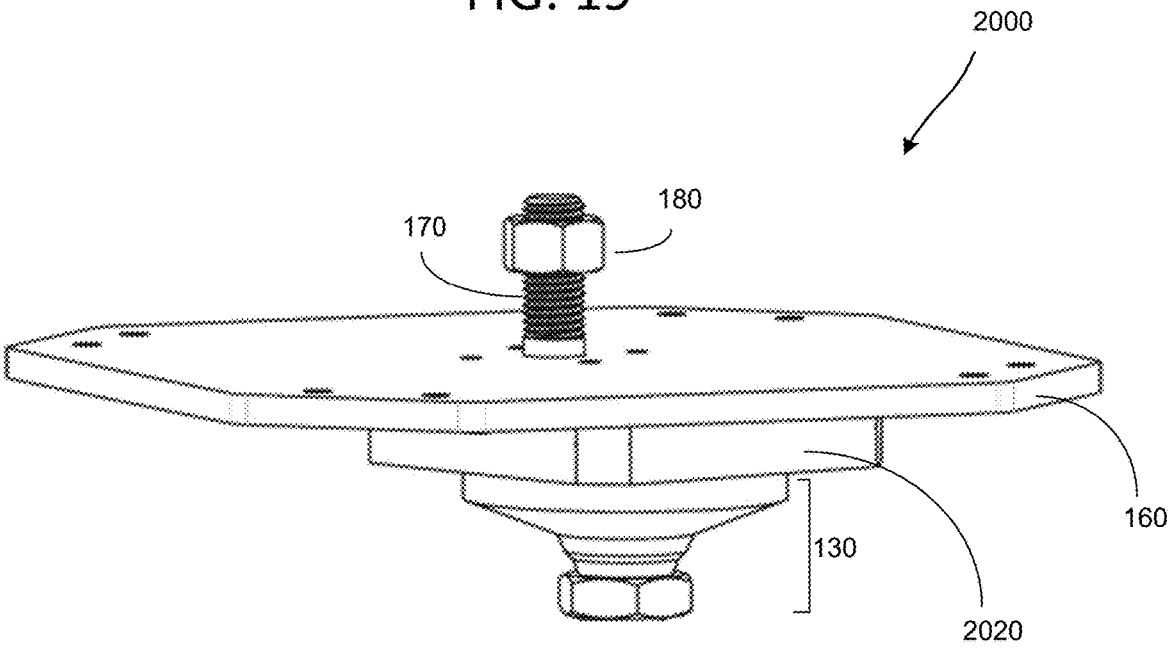
FIG. 20 is a three-dimensional perspective view of a foundation structure in accordance with some embodiments of the present disclosure.

FIG. 20 depicts an embodiment of a foundation structure 2000 that includes a ball joint 130, a slotted plate 2020, and a load bearing plate 160, where a bolt may be inserted through a slot in the slotted plate 2020 and through a hole in the load bearing plate 160 (secured by a nut 180). Foundation structure 2000 is similar to the foundation structure 1900 illustrated in FIG. 19 except that a single slotted plate is used instead of distinct base and capture plates. In the embodiment of FIG. 20, slotted plate 2020 functions in a manner similar to capture plate 150 to prevent vertical movement of bolt 170. An exemplary slotted plate 2020 may have a stepped slot (configured with a series of steps, or components of different widths/lengths) or an angled slot to fasten the load bearing plate to the rest of the foundation structure, and to prevent the anchor bolt 170 from lifting off the foundation structure, though other configurations are possible in other embodiments. In another embodiment (not shown) along the lines of FIG. 20, rather than a slotted plate 2020 discrete from the ball joint 130, a single integral structure that contains both a ball joint mechanism and a bolt capture mechanism may be used. Further, in alternate embodiments, the foundation structure 2000 may also include one or more additional plates that act to connect the load bearing plate to a portion of a superstructure (e.g., a building) positioned above the foundation structure.

By virtue of the features described above and in FIGS. 1A through 20, an above-ground foundational structure can be provided that allows for three types of movement: vertical, angular, and lateral. As described above, vertical adjustment may be done through vertical telescoping of a screw connected to a pile, angular adjustment may be done through pivoting of the ball joint resulting in an angular offset of the plates positioned above, and lateral adjustment may be done through movement of a bolt within the slotted plates to facilitate a lateral movement of the load bearing plate. These three types of movement allow for various degrees of installation tolerance to be introduced, that is, a potential amount of misalignment or offset of an installed pile can be tolerated without requiring extensive re-installation or repositioning of the pile.

The superstructures (such as buildings) using the foundation structures described herein may be designed to be assembled at any location irrespective of the geographic locations and soil conditions. In this regard, different geographic conditions may require different types of foundational structure. For example, a geographic location where the ground level is uneven, may traditionally require a certain type of foundation structure (incorporating height differences at various points of installation of the foundation structure for the same housing structure), whereas a geographic location on level ground may traditionally require another type of foundation structure and/or may require significant work to have the site graded. The exemplary foundation structures described herein may be installed at any location irrespective of the geographic conditions, as the foundation structure may accommodate for height differences inherent to the geographic location. In this regard, the exemplary foundation structure may be installed at different points of the same housing structure at different heights, as required to support the superstructure at each point of installation.

Further, shallow foundations may not be suitable at places where the soil at shallow depth is unstable due to the presence of expansive soils or frost heave. The foundation structures described herein may incorporate a deep foundation, wherein the load from a superstructure may be transferred to deep layers of soil, making it suitable for deployment at different soil conditions. Hence, where deep foundations (e.g., piles) are appropriate, the exemplary foundation structure mitigates or reduces the elements of a foundation structure that must be specially-designed based on geography. Additionally, even in geographic conditions where a shallow foundation is appropriate, the alignment-facilitating anchor bolt 170, slotted plates 140 and 150, and rotatable ball joint 130 may still be implemented (as shown in FIGS. 1-20) to align the superstructure with the shallow foundation element that acts to transfer the load(s) of the superstructure to the soil. Still further, a foundation structure may be positioned with greater or lesser amounts of flexibility/rigidity, depending on the environmental needs of the structure. For instance, in geographically unstable conditions (e.g., in environments that are earthquake prone or where significant settling of the structure may be expected), a greater degree of flexibility may be built into the foundation components to allow for unintended adjustment without damage to the structural components.

What is more, the components of the foundation structures described herein can be disassembled and reused without any structural damage to those parts, allowing for reuse, reconfiguration, and/or recycling of those parts in a replacement or alternate structure. More particularly, component parts of the foundation structures described herein are connected through temporary means (e.g., detachable) in a manner that does not cause physical damage to any component, such as fasteners like bolts, screws, rivets or through methods like insertion. As a result, after the intended period of use of the foundation structure, the component materials themselves have experienced minimal wear and tear, and are in a condition for reuse. Because of the reusability of the component parts, high-quality materials may be used, thereby improving the durability of the material and their weather and/or environment fitness.

Method of Installation

Figure 21:
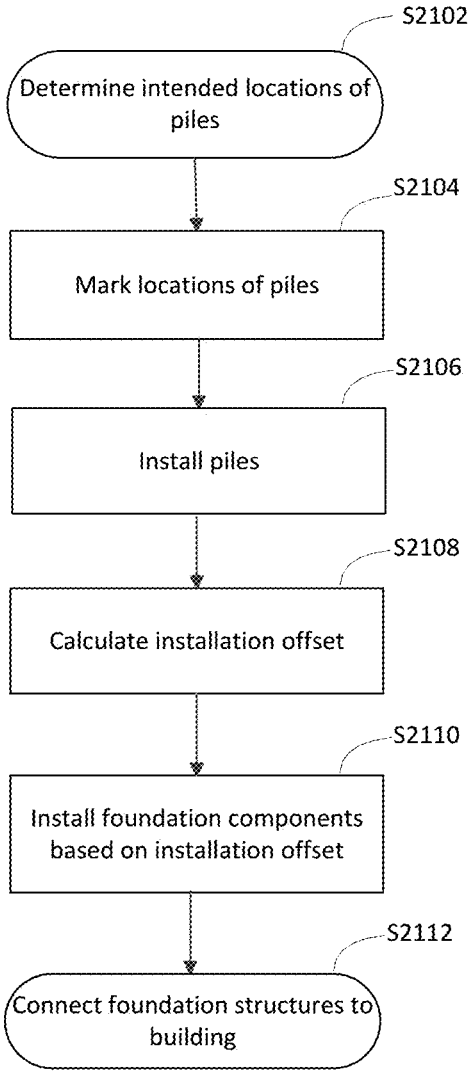
FIG. 21 is a flow chart depicting a method of installation of a foundation structure in accordance with some embodiments of the present disclosure.

An exemplary method of installation of several foundation structures 100 (as illustrated in FIG. 1A) for a building will be described with reference to FIG. 21. This method is exemplary in nature, and other methods of installation may be used as is appropriate depending on, e.g., the environment conditions of the soil, the weather, the size and experience of the installation team, the size of the superstructure, and other factors.

Initially, the locations at which each of the piles is intended to be installed are determined (Step S2102). In some embodiments, this may be done based on a perimeter floor beam layout of the building, based on a number and position of foundation structures needed to support each end of every perimeter beam and take high structural demands off of the flooring of the building. The locations for the piles may be marked by, e.g., the placement of stakes or markers (Step S2104). In some embodiments, a laser grid (or other lighted or holographic projection indicating the intended locations of pile placement) may be used to superimpose upon the ground the positions and/or configurations at which the piles and foundation structures are intended to be installed. Using known methods of installation (e.g., boring, drilling, etc.), foundation piles may be installed (Step S2106), using the marked locations as guide points. The actual installation positions of the piles as compared to their respective intended installation points, i.e., the value of any installation offset, may then be determined (S2108). In one embodiment, a vertical and/or horizontal level of the pile may be determined through use of a bubble level, laser level, zip level, or the like, and the lateral displacement of a pile may be measured through a visual and/or calculated comparison of the installation position to the marked location, though other methods may be used. The amount/severity of offset from the intended position may be noted.

Different configurations of foundation structure 100 may allow the accommodation of different degrees of offset. Therefore, in one embodiment, a particularly sized/shaped foundation structure 100 may be used with a respective pile. In one embodiment, where the position of a pile deviates within a certain distance range, a particularly sized pile cap may be used to accommodate the foundation structure components that will be positioned above. The other components of the foundation structure (e.g., a ball joint/base plate/capture plate, and load bearing plate as described in FIGS. 1-20) may be thereafter installed (S2110). This installation can be done in consideration of the calculated offset, e.g., by adjusting the vertical, lateral, and/or angular position of the foundation structure in the manner described above with reference to FIGS. 5A through 15B to accommodate the calculated offset. The load bearing plate (or an intermediate foundational support plate) may then be connected to one or more floor structures of the building (S2112).

In an alternate embodiment, environmental loads such as heavy wind and seismic activity may require the foundation to provide additional lateral support to the superstructure. In such a scenario, the lateral force resistance of the foundation structures may be adjusted. As one example, additional lateral force resisting elements may be attached to a foundation structure, e.g., through the use of fasteners like bolts, screws, rivets, or the like. For instance, where ground is uneven, and/or where seismic forces may result in unintentional lateral movement of the superstructure or load bearing plate of the foundation structure, additional lateral bracing may be installed to restrict movement in one or more particular directions.

In another method of installation, a flooring grid of a building may be constructed in advance where the flooring beams are only loosely coupled (directly or indirectly) to each other. The flooring grid may be placed atop the installed piles and foundation structures. Each foundation structure may thereafter be adjusted (vertically, laterally, and/or angular) to accommodate one or more corresponding elements of the flooring grid. When the foundation structure is adjusted such that the corresponding flooring element is level, the coupling between the flooring element and flooring beams may be tightened into place. Further, because the foundation is adjustable, other alternate embodiments may include a completely rigid (or almost rigid) floor structure.

In yet another method of installation, a laser-base, augmented reality, or otherwise imaged representation of a flooring grid of a building and/or relevant component parts of the building may be projected onto a space above the intended points of installation. After the piles and foundation structures are installed in place, adjustments may be made (vertically, laterally, and/or angular) to respective foundation structures to conform to the projected image of the flooring elements (e.g., flooring beam intersections/layout) of the building. The actual flooring and building components may be later installed after all the prerequisite adjustments to the foundation structures have been made. By these means, there is no need to first install and then realign heavy and/or unwieldy flooring beams and other building components.

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

As a further example, variations of apparatus or process parameters (e.g., dimensions, configurations, components, process step order, etc.) may be made to further optimize the provided structures, devices and methods, as shown and described herein. In any event, the structures and devices, as well as the associated methods, described herein have many applications. Therefore, the disclosed subject matter should not be limited to a single embodiment described herein, but rather should be construed in breadth and scope in accordance with the appended claims.

What is claimed is:

1. A foundation structure comprising:

a pile;

a threaded cap coupled to and positioned at an uppermost portion of the pile;

a telescoping screw inserted into the threaded cap, the screw being adjustably inserted to one or more vertical positions;

a ball joint including, at one side, a connection portion into which the telescoping screw is threaded, and at a side remote from the telescoping screw, a base plate having a first hollow slot that is (i) capable of receiving a head of an anchor bolt and (ii) greater in length than a diameter of the head of the anchor bolt;

a capture plate, positioned at a side of the base plate remote from the ball joint, the capture plate having a second hollow slot that is (i) narrower in width than the head of an anchor bolt and (ii) capable of receiving a shank of the anchor bolt; and a load bearing plate positioned at a side of the capture plate remote from the ball joint, wherein the base plate, the capture plate, and the load bearing plate are, as a unitary structure, rotationally adjustable on the ball joint relative to the pile.

2. The foundation structure of claim 1, wherein the ball joint is coupled to the telescoping screw, and the load bearing plate is detachably coupled to the capture plate.

3. The foundation structure of claim 1, wherein the load bearing plate comprises a hole, wherein the foundation structure further comprises an anchor bolt positioned within the first hollow slot and extending through the second hollow slot and the hole in the load bearing plate, and wherein the anchor bolt is laterally translatable within the first hollow slot and the second hollow slot relative to the pile.

4. The foundation structure of claim 1, further comprising a foundation mounting component positioned adjacent to and coupled to the load bearing plate at a side remote from the ball joint, wherein the foundation mounting component is configured to be coupled to a flooring structure of a building.

5. A foundation structure comprising:

a pile;

a pile cap coupled to the pile;

a first adjustable element, wherein a first end of the first adjustable element is configured to be inserted into the pile cap such that the first end is adjustable from a first vertical position within the pile cap to a second vertical position within the pile cap;

a second adjustable element comprising a base portion and a body portion, the base portion being detachably coupled to a second end of the first adjustable element opposite to the first end, and the body portion being located at a side of the base portion remote from the first adjustable element, wherein the body portion is coupled to the base portion in a manner allowing the body portion to be pivoted so as to tilt with respect to a vertical axis passing through a center of the base portion and a center of the first adjustable element, the pivoting allowing for rotational movement of the body portion in at least one direction other than a vertical direction;

a fastening element;

a first plate coupled to the body portion of the second adjustable element at a side of the second adjustable element remote from the first adjustable element, the first plate having a first hollow slot extending laterally within the first plate, the first hollow slot being capable of receiving a portion of the fastening element; and a second plate detachably coupled to the first plate at a side remote from the second adjustable element, the second plate having an opening capable of receiving a portion of the fastening element, wherein the fastening element is positioned such that the fastening element extends vertically through the first hollow slot of the first plate and the opening of the second plate, wherein the fastening element is laterally adjustable within the first hollow slot, and wherein, when the fastening element is laterally adjusted within the first hollow slot, the second plate is laterally adjusted in correspondence with the lateral adjustment of the fastening element.

6. The foundation structure of claim 5, wherein the first plate and the second plate, as a unitary structure, are pivoted on the second adjustable element relative to the pile.

7. The foundation structure of claim 5, where the interior of the pile cap is threaded, the first adjustable element is threaded, and an interior of the base portion of the second adjustable element is threaded.

8. The foundation structure of claim 5, further comprising:

an intermediate plate positioned between the first plate and the second plate, the intermediate plate having a second hollow slot.

9. The foundation structure of claim 8, wherein the fastening element is an anchor bolt, wherein a head of the anchor bolt is received in the first hollow slot and a shank of the anchor bolt is received in the second hollow slot, and wherein the anchor bolt is capable of travelling laterally in the first hollow slot and the second hollow slot.

10. The foundation structure of claim 8, wherein the first hollow slot is of a first width, the first width being at least at large as the width of a head of the fastening element, and wherein the second hollow slot is of a second width, the second width being smaller than the width of the head of the fastening element and being at least at large as the width of a shank of the fastening element.

11. The foundation structure of claim 5, wherein a length of the first hollow slot is greater than a diameter of the head of the anchor bolt.

12. The foundation structure of claim 5, wherein the fastening element is adjusted in a lateral direction relative to the pile.

13. The foundation structure of claim 5, wherein the first plate and the second plate are rotationally adjustable on the second adjustable element around the vertical axis of the first adjustable element.

14. A structure comprising:

a ball joint having a ball portion and a body portion, the body portion being rotatable with respect to the ball portion;

a first plate having a first slot that is (i) capable of receiving a head of a fastener and (ii) greater in length than a diameter of the head of the fastener;

a second plate, positioned at a side of the first plate remote from the ball joint, the second plate having a second slot that is (i) narrower in width than the head of an anchor bolt and (ii) capable of receiving a shank of the fastener; and a third plate positioned at a side of the second plate remote from the ball joint, the third plate having a hole, wherein the fastener is positioned within the first slot so as to extend through the second slot and the hole.

15. The structure of claim 14, wherein the first plate is permanently affixed to the body portion of the ball joint.

16. The structure of claim 14, wherein the third plate is detachably coupled to the second plate.

17. The structure of claim 14, wherein the first plate, the second plate, and third plate, as a unitary structure, are pivoted on the ball joint with respect to the ball portion via rotation of the body portion around the ball portion.

18. The structure of claim 17, wherein when the first plate, the second plate, and third plate are pivoted on the ball joint, the hole of the third plate is translated (a) from a first vertical position to a second vertical position, and (b) from a first horizontal portion to a second horizontal position.

19. The structure of claim 14, wherein the fastener is laterally adjustable within the first slot and the second slot.

20. The structure of claim 19, wherein the third plate is laterally adjustable in correspondence with lateral movement of the fastener.

* * * * *